US008308270B2

(12) United States Patent
Ohnishi et al.

(10) Patent No.: US 8,308,270 B2
(45) Date of Patent: Nov. 13, 2012

(54) IMAGE FORMING APPARATUS

(75) Inventors: Masashi Ohnishi, Kanagawa (JP); Junji Seto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 425 days.

(21) Appl. No.: 12/618,029

(22) Filed: Nov. 13, 2009

(65) Prior Publication Data

US 2010/0165040 A1 Jul. 1, 2010

(30) Foreign Application Priority Data

Dec. 29, 2008 (JP) ..... 2008-335725

(51) Int. Cl.
*B41J 2/165* (2006.01)
*B41J 25/308* (2006.01)

(52) U.S. Cl. ..... 347/36; 347/8

(58) Field of Classification Search ..... None
See application file for complete search history.

(56) References Cited

U.S. PATENT DOCUMENTS

| | | | | |
|---|---|---|---|---|
| 5,266,975 | A * | 11/1993 | Mochizuki et al. | 347/23 |
| 6,364,449 | B1 * | 4/2002 | Takahashi et al. | 347/30 |
| 2009/0315943 | A1 * | 12/2009 | Ohnishi et al. | 347/36 |

FOREIGN PATENT DOCUMENTS

| | | |
|---|---|---|
| JP | 2005-199598 | 7/2005 |
| JP | 2006-247880 | 9/2006 |
| JP | 2007-144904 | 6/2007 |

OTHER PUBLICATIONS

U.S. Appl. No. 12/486,109, filed Jun. 17, 2009 of Masashi Ohnishi et al.

* cited by examiner

*Primary Examiner* — Matthew Luu
*Assistant Examiner* — Erica Lin
(74) *Attorney, Agent, or Firm* — Cooper & Dunham LLP

(57) ABSTRACT

An image forming apparatus includes a recording head having a nozzle configured to jet a liquid drop of ink; a cap member configured to be moved between a sealing position where a nozzle surface of the recording head is sealed and an opening position where the nozzle surface is opened; a waste liquid tank movably provided and configured to receive a waste liquid of the ink, the waste liquid being generated by idle-ejecting the liquid drop not contributing to image forming from the recording head; and a moving part configured to move the waste liquid tank tied to movement of the cap member. A position of the waste liquid tank in a case of idle-ejection being performed from the recording head last time and another position of the waste liquid tank in a case of idle-ejection being performed from the recording head this time are different.

9 Claims, 19 Drawing Sheets

IMAGE FORMING APPARATUS

CROSS-REFERENCE TO RELATED APPLICATIONS

This patent application is based upon and claims the benefit of priority of Japanese Patent Application No. 2008-335725 filed on Dec. 29, 2008, and the entire contents of which are incorporated herein by reference.

BACKGROUND OF THE INVENTION

1. Field of the Invention

The present invention generally relates to image forming apparatuses. More specifically, the present invention generally relates to an image forming apparatus having a waste liquid tank configured to receive waste liquid generated by a maintaining and recovering operation of a recording head, the recording head being configured to eject liquid drops.

2. Description of the Related Art

As an image forming apparatus such as a printer, facsimile machine, copier, plotter, or a multiple function processing machine including the printer, facsimile machine, copier, and the plotter, an inkjet recording apparatus is known. The inkjet recording apparatus is a liquid ejection recording type image forming apparatus using a recording head configured to eject ink liquid drops.

In this liquid ejection recording type image forming apparatus, the ink liquid drops are ejected from the recording head onto a conveyed sheet so that image forming such as recording or printing is performed. In the liquid ejection recording type image forming apparatus, there are two kinds of image forming apparatuses. One is a serial type image forming apparatus configured to eject liquid drops so that an image is formed while a recording head moves in a main scanning direction. The other is a line type image forming apparatus using a line type head whereby liquid drops are ejected while the recording head does not move so that an image is formed.

Hereinafter, the "image forming apparatus" means an apparatus configured to eject liquid onto a medium such as a paper, thread, fiber, leather, hides, metal, plastic, glass, wood, or ceramic so that images are formed. The image forming apparatus includes a mere liquid ejecting apparatus. In addition, "image forming" means not only providing an image of characters, figures, or the like on the medium but also providing an image such as a pattern having no meaning on the medium. "Image forming" includes adherence of the liquid drops onto the medium.

Furthermore, "ink" is not limited to recording liquid or ink and any liquid that is a fluid when being ejected can be applied to the liquid such as fixing liquid. In addition, "sheet" is not limited to a paper but includes an OHP sheet or leather, for example. In other words, the sheet means a subject where the ink drops are adhered. The sheet includes a recorded medium, a recording medium, a recording paper, and a recording sheet.

In such an image forming apparatus (hereinafter "inkjet recording apparatus"), the ink is ejected from the nozzle so that recording is performed. Accordingly, degradation of ejecting capabilities of the recording head may be caused based on an increase of ink viscosity due to evaporation of a solvent from the nozzle, solidification of the ink, adherence of dust, mixture of bubbles, or the like. Because of this, the image forming apparatus has a maintaining and recovering mechanism configured to maintain and recover proper operation of the recording head.

For example, a cap (called a capping member, a cap member, or the like) configured to seal the nozzle of the recording head is provided in the image forming apparatus. By capping the recording head when the image forming apparatus is not being operated, drying or thickening of the ink in the nozzle can be prevented. In addition, during or before/after the recording operations, the ink drops which do not contribute to the recording operations are ejected so that the ink being dried or thickened in the nozzle is discharged, thereby recovering or maintaining ejecting capabilities.

Ejecting a liquid drop for maintaining the ejecting capabilities of the nozzle, which liquid drop does not contribute to image forming, is called preliminary ejecting or idle ejecting. Such a liquid drop is ejected to an exclusive idle ejecting receiver or the cap.

In the meantime, since the idle-ejected ink has a small drop amount and may be easily dried, thickened ink (ink having a high viscosity) may be easily formed. In addition, in a case where a stacked material made of the thickened ink is formed in the idle ejecting position so that the stacked material grows to a height reaching the recording head, degradation of ejecting the ink due to adhesion of the ink to the recording head may be caused or the recording medium may become dirty due to the ink adhered to the recording head being transferred to the recording medium.

The recording head is covered with a suction cap (cap member) so that a maintaining and recovering function (mechanism) is performed whereby the ink is removed from the recording head by the suction cap.

The waste liquid of the ink collected by the maintaining and recovering mechanism is discharged to a waste liquid receiver (waste liquid tank) having a suction member. Since the ink removed from the head has a relatively low viscosity but pigment ink includes solid contents such as pigment, a deposition due to drying of the ink is formed in an ink liquid drop area. More specifically, an ink stack such as a pillar is formed in a high temperature and low moisture atmosphere where the drying rate is relatively high.

Because of this, the waste liquid may overflow before space in the waste liquid tank is effectively used, and the service life time of the waste liquid tank may be shortened. In this case, in order to extend the service life time of the waste liquid tank, the height of the liquid tank may be extended. However, in this case, the size of the image forming apparatus becomes large and therefore there is a limitation to the extension of the height of the waste liquid tank.

A structure where relative positions of a discharge part of the ink and an exit path where the ink passes are changed by using a sublimation material such as a camphor and an elastic member such as a spring has been suggested, for example, in Japanese Laid-Open Patent Application Publication No. 2006-247880.

In addition, a structure where the ink is idle-ejected onto a movable member provided on the tank and the ink adhered to the movable member is scratched out by moving the movable member so as to be discharged to a place separated from the idle ejecting position has been suggested, for example, in Japanese Laid-Open Patent Application Publication No. 2005-199598.

Furthermore, a structure where there is a space at a bottom part in an ink discharge position of a waste liquid receiver so that a solvent is stored in the space and stacking is prevented, has been suggested, for example, in Japanese Laid-Open Patent Application Publication No. 2007-144904.

However, the above-mentioned related art image forming apparatus or the waste liquid receiver (waste liquid tank) has the following problems.

In the structure discussed in Japanese Laid-Open Patent Application Publication No. 2006-247880 where relative positions of a discharge part of the ink and an exit path where the ink passes are changed by using a sublimation material such as a camphor and an elastic member such as a spring, the sublimation material is sublimated if it has not been used for a long period of time, so that it is difficult to scatter the ink from the stacking position.

In the structure discussed in Japanese Laid-Open Patent Application Publication No. 2005-199598 where the ink is idle-ejected onto a movable member provided on the tank and the ink adhered to the movable member is scratched out by moving the movable member so as to be discharged to a place separated from the idle ejecting position has been suggested, the ink adhered to the movable member is discharged to the same portion and thereby the ink is stacked and fixed on the movable member and thereby the movable member may become not movable.

In the structure discussed in Japanese Laid-Open Patent Application Publication No. 2007-144904 where there is a space at a bottom part in an ink discharge position of a waste liquid receiver so that a solvent is stored in the space and stacking is prevented, the solvent may flow into the image forming apparatus at the time when the image forming apparatus is transported or provided.

SUMMARY OF THE INVENTION

Accordingly, embodiments of the present invention may provide a novel and useful image forming apparatus solving one or more of the problems discussed above.

More specifically, the embodiments of the present invention may provide an image forming apparatus wherein the service life time of a waste liquid tank can be extended without increasing the height of the image forming apparatus.

One aspect of the present invention may be to provide an image forming apparatus, including a recording head having a nozzle configured to jet a liquid drop of ink; a cap member configured to be moved between a sealing position where a nozzle surface of the recording head is sealed and an opening position where the nozzle surface is opened; a waste liquid tank movably provided and configured to receive a waste liquid of the ink, the waste liquid being generated by idle-ejecting the liquid drop not contributing to image forming from the recording head; and a moving part configured to move the waste liquid tank tied to movement of the cap member, wherein a position of the waste liquid tank in a case of idle-ejection being performed from the recording head last time and another position of the waste liquid tank in a case of idle-ejection being performed from the recording head this time are different.

Another aspect of the present invention may be to provide an image forming apparatus, including a recording head having a nozzle configured to jet a liquid drop of ink; a wiper member configured to be moved between a wiping position where a nozzle surface of the recording head is wiped and a non-wiping position where the wiper member is separated from the nozzle surface; a waste liquid tank movably provided and configured to receive a waste liquid of the ink, the waste liquid being generated by idle-ejecting the liquid drop not contributing to image forming from the recording head; and a moving part configured to move the waste liquid tank tied to movement of the wiper member, wherein a position of the waste liquid tank in a case of idle-ejection being performed from the recording head last time and a position of the waste liquid tank in a case of idle-ejection being performed from the recording head this time are different.

Another aspect of the present invention may be to provide an image forming apparatus, including a recording head having a nozzle configured to jet a liquid drop of ink; a conveyance part configured to convey a sheet; a waste liquid tank provided movably and configured to receive a waste liquid of the ink generated by idle-ejecting the liquid drop not contributing to image forming from the recording head; and a moving part configured to move the waste liquid tank tied to movement of the conveyance part, wherein a position of the waste liquid tank in a case of idle-ejection being performed from the recording head last time and another position of the waste liquid tank in a case of idle-ejection being performed from the recording head this time are different.

According to the embodiments of the present invention, the waste liquid tank is moved tied to the movement of the cap member, the wiper member, or the conveyance part so that the position of the waste liquid tank in a case of idle-ejection being performed from the recording head last time and the position of the waste liquid tank in the case of idle-ejection being performed from the recording head this time are different. Accordingly, the discharge position of the waste liquid relative to the waste liquid tank is changed and it is possible to extend the service life time of the waste liquid tank without increasing the height of the image forming apparatus.

Additional objects and advantages of the embodiments will be set forth in part in the description which follows, and in part will be obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

BRIEF DESCRIPTION OF THE DRAWINGS

A more complete appreciation of the invention and many of its attendant advantages may be readily obtained through better understanding by reference to the following detailed description when considered in connection with the accompanying drawings, wherein.

DETAILED DESCRIPTION OF THE PREFERRED EMBODIMENTS

A description is given below, with reference to the FIG. 1 through FIG. 20 of embodiments of the present invention.

Figure 1:
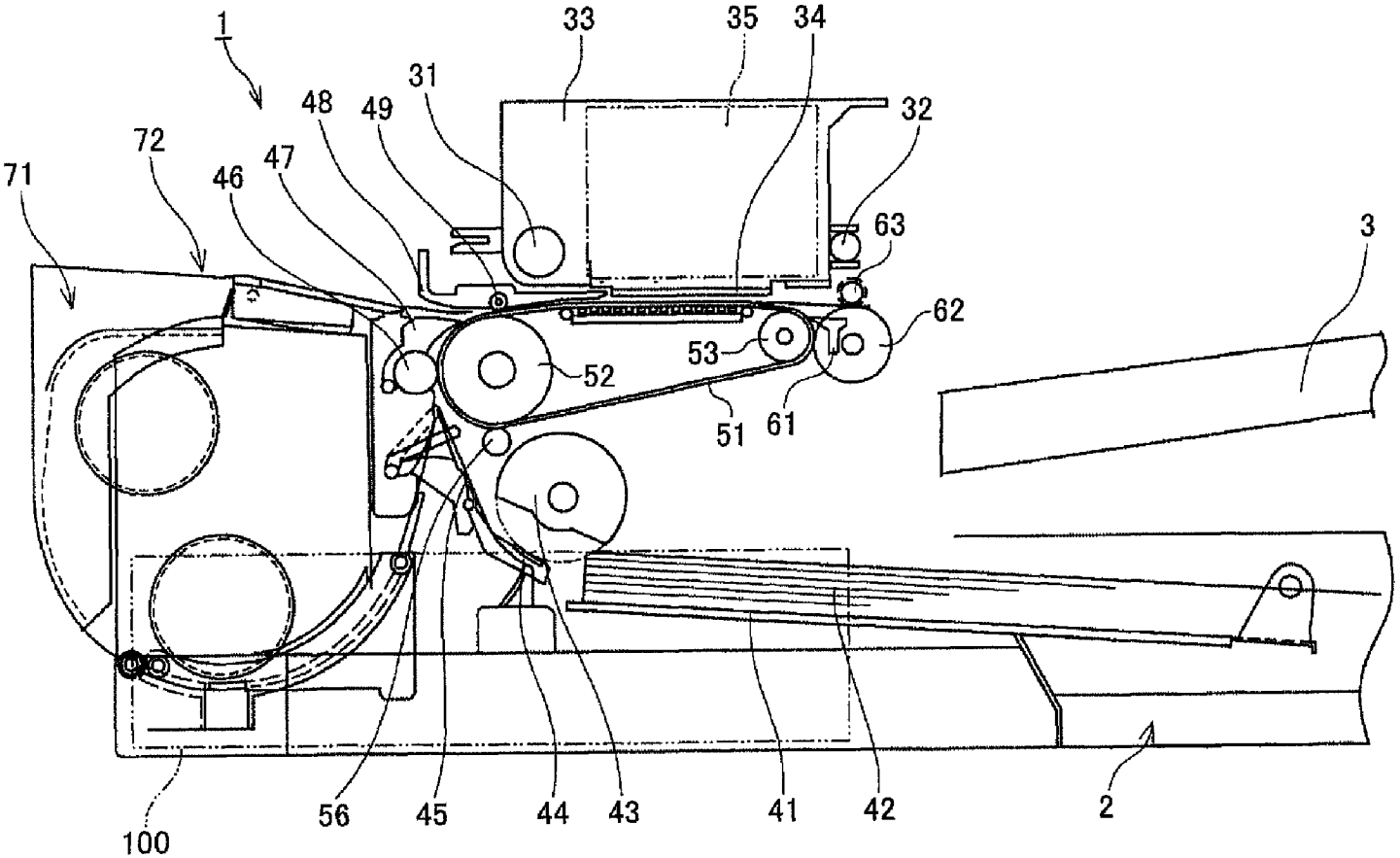
FIG. 1 is a schematic structural view of a mechanism part of an image forming apparatus of an example of the present invention.
Figure 2:
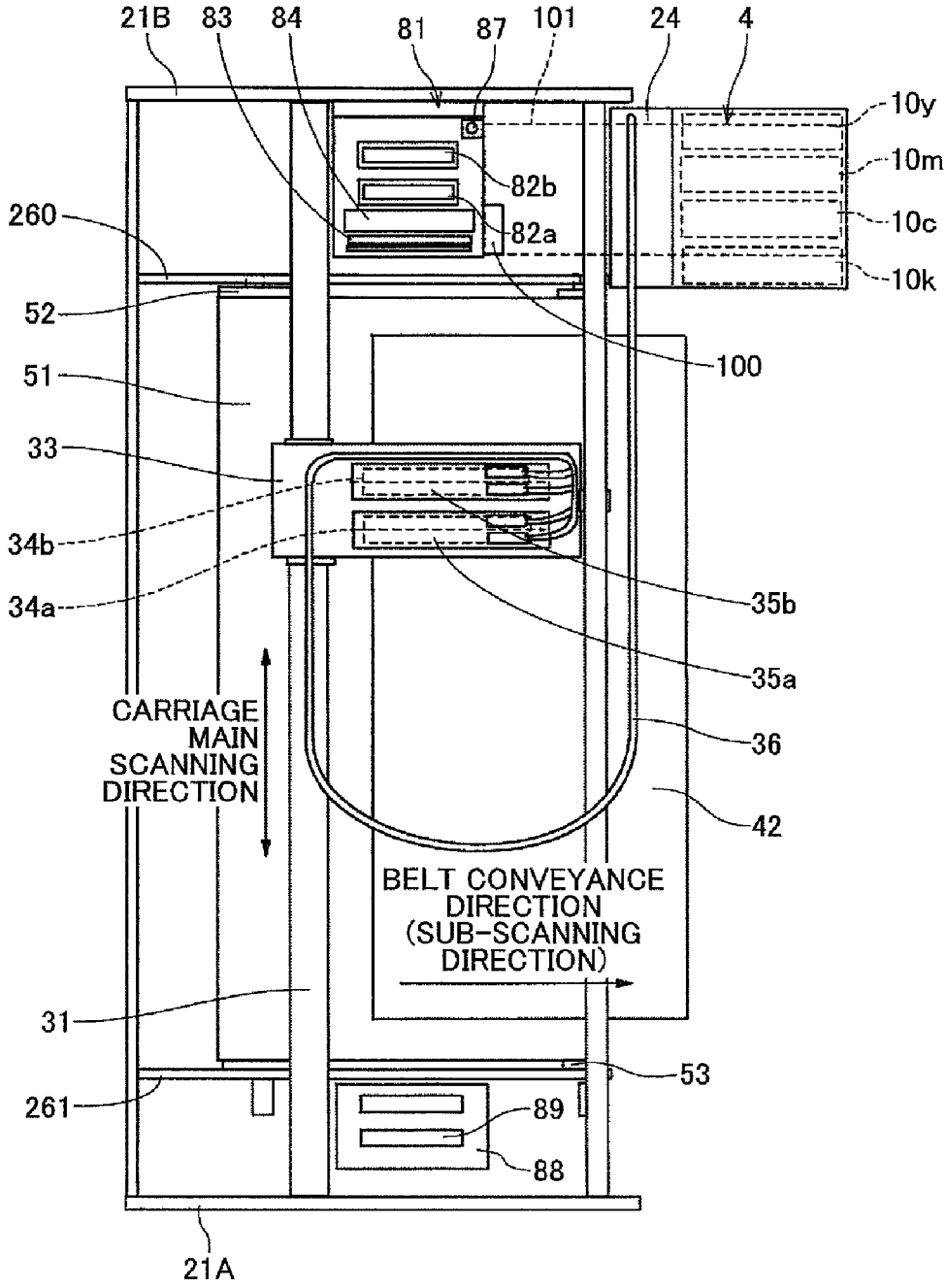
FIG. 2 is a schematic drawing showing a plan view of a main portion of the mechanism part of the image forming apparatus according to the example of the present Invention.

First, an example of an image forming apparatus of the present invention is discussed with reference to FIG. 1 and FIG. 2. FIG. 1 is a schematic structural view of a mechanism part of the image forming apparatus of the example of the present invention. FIG. 2 is a schematic drawing showing a plan view of a main portion of the mechanism part of the image forming apparatus.

The image forming apparatus of the present embodiment is a serial type image forming apparatus and includes a main guide rod 31 and a sub-guide rod 32 which are supported at their lateral ends by side boards 21A, 21B. The main guide rod 31 and the sub-guide rod 32 hold a carriage 33 slidable in a main scanning direction. The carriage 33 is moved by a main scanning motor (not shown) via a timing belt in the direction indicated by an arrow (carriage main scanning direction) in FIG. 2.

The carriage 33 carries a liquid eject head 34 including recording heads 34A and 34B configured to eject ink liquids of yellow (Y), cyan (C), magenta (M), and black (K). Plural nozzles are arranged in rows, and the rows of the nozzles are disposed in a sub-scanning direction, which is orthogonal to the main scanning direction of the carriage. An ink liquid ejection direction is downward.

The recording heads 34A and 34B each include two rows of nozzles. The recording head 34A ejects black (K) ink liquid from nozzles arranged in one row, and cyan (C) ink liquid from nozzles arranged in a second row. The recording head 34B ejects magenta (M) ink liquid from nozzles arranged in one row, and yellow (Y) ink liquid from nozzles arranged in a second row.

Sub-reservoirs 35*a*, 35*b*, which hold in reserve the four color ink liquids corresponding to the ink liquids ejected from the recording heads 34A and 34B, are mounted on the carriage 33. The ink liquids are delivered from ink cartridges 10*y*, 10*m*, 10*c*, and 10*k* to the sub-reservoirs 35*a* and 35*b* (sub-reservoir 35) by a pump unit 24 via delivering lines 36. The ink cartridges 10*y*, 10*m*, 10*c*, and 10*k* are detachably attached to a cartridge mounting portion 4.

The image forming apparatus of the present embodiment includes a crescent-shaped roller 43 and a dividing pad 44 which is biased toward the roller 43. Sheets 42 are loaded on a sheet loading portion 41, which is composed of a pressure plate of a feeding tray 2. The roller 43 and the dividing pad 44 are disposed as a sheet feeding portion that feeds the sheets 42 one by one from the sheet loading portion 41.

The image forming apparatus of the present embodiment includes a guide portion 45 configured to guide the sheet 42 so that the sheet 42 fed by a sheet feeding part is transferred to a position below the recording head 34, a counter roller 46, a conveyance guide portion 47, a holding member 48 which includes a press roller 49, and a conveyance belt 51. The conveyance belt 51 is configured to hold the sheet 42 by electrostatic attraction and convey the sheet 42 relative to the position of the recording heads 34A and 34B.

The conveyance belt 51 is a looped (endless) belt, which is trained about a conveyance roller 52 and a tension roller 53, and rotates in a belt conveyance direction (sub-scanning direction), i.e. clockwise direction in FIG. 1. The image forming apparatus of the present embodiment includes a charged roller 56 which is electrostatically charged and configured to charge a surface of the conveyance belt 51. The charged roller 56 contacts the surface of the conveyance belt 51, and is rotated by the conveyance belt 51. The conveyance belt 51 is rotated in the belt conveyance direction (sub-scanning direction) shown in FIG. 2 by the conveyance roller 52, which is rotated by a sub-scanning motor (not shown). The conveyance roller 52 and the tension roller 53 are rotatably supported by sub-side plates 260 and 261.

In addition, the image forming apparatus of the present embodiment includes, as a sheet discharge part configured to discharge the sheet 42 recorded by the recording head 34, a separating claw 61, a sheet discharge roller 62, and a small sheet discharge roller 63. The separating claw 61 is configured to separate the sheet 42 from the conveyance belt 51. A sheet discharge tray 3 is disposed underneath the sheet discharge roller 63.

A two-surfaces unit 71 is detachably attached to a rear surface part of an apparatus main body 1. The two-surfaces unit 71 receives the sheet 42 which is fed by reverse rotation of the feeding belt 51, and then reverses and feeds the sheet 42 between the conveyance belt 51 and the counter roller 46 again. The two-surfaces unit 71 includes a manual tray 72 on its top surface.

Furthermore, a maintaining and recovering mechanism 81 is arranged in a non-recording area located at one end of the main scanning direction of the carriage 33. The maintaining and recovering mechanism 81 is configured to maintain and recover operating states of the ejecting heads 34A and 34B. The maintaining and recovering mechanism 81 includes cap members (caps) 82*a* and 82*b* configured to cap the nozzle surfaces of the ejecting heads 34A and 34B, respectively, a wiper member (a wiper blade) 83 configured to wipe (clean up) the nozzle surfaces, an idle-eject receiving part 84 configured to receive liquid drops which do not contribute to recording so that thickened recording liquid is discharged, and a carriage lock 87 configured to lock the carriage 33.

A first waste liquid tank 100 (as an example of a waste liquid tank in claims below) is provided below the maintaining and recovering mechanism 81. The first waste liquid tank 100 is configured to receive waste liquid which is generated from the idle-eject receiving part 84 by the idle-ejecting to the idle-eject receiving part 84 or wiping the wiper member 83 of the maintaining and recovering operation. The first waste liquid tank 100 is not replaceable but movably provided. On the other hand, a second waste liquid tank 101 is provided at a side (apparatus main body front surface side) of the maintaining and recovering mechanism 81. The second waste liquid tank 101 is provided so as to be exchanged at a lower side of the cartridge mounting portion 4 from a front surface side of the apparatus main body. The ink cartridges 10 and the second waste liquid tank 101 can be exchanged from the apparatus main body front surface side by opening a common cover of a front surface of the apparatus main body and thereby cost reduction can be achieved.

In addition, as shown in FIG. 2, an idle-ejecting receiving part 88 is provided in a non-recording area located at the other end of the main scanning direction of the carriage 33. The idle-ejecting receiving part 88 is configured to receive ejected liquid drops which do not contribute to recording so that the recording liquid thickened during recording is discharged. The idle-ejecting receiving part 88 includes an opening 89 formed along the row of the nozzles of the recording head 34A (or 34B).

The image forming apparatus as described above feeds the sheets 42 one by one from the sheet feeding tray 2, and guides the sheet 42 upward along the guide portion 45. The sheet 42 is fed in between the belt 51 and the counter roller 46, guided by the guide portion 47, and then pressed to the feeding belt 51 by the press roller 49 by turning approximately 90 degrees from the guide portion 45.

The image forming apparatus applies an alternating current of positive voltage and negative voltage to the charged roller 56 while the sheet 42 is guided along the feeding belt 51. Thus, an alternating charge distribution of positive charges and negative charges of predetermined length is applied to the conveyance belt 51 in the sub-scanning direction, i.e. the rotational direction of the conveyance belt 51. When the sheet 42 is fed by the conveyance belt 51 with the alternating charge distribution, the sheet 42 is attracted electrostatically to the conveyance belt 51 and conveyed in the sub-scanning direction by the rotation of the conveyance belt 51.

The image forming apparatus moves the carriage 33, and activates the ejecting heads 34A, 34B in response to an image signal. Thus, the stopped sheet 42 is recorded one line at a time by ejecting the ink liquid from the ejecting heads 34A, 34B. After the sheet is conveyed by a designated amount, recording the next line is performed. The image forming apparatus stops recording the sheet 42 and discharges the sheet 42 to the sheet discharge tray 3 when the image forming apparatus detects a recording end signal or a signal indicating that the and of the sheet 42 has reached the recording area.

When maintaining and recovering of the nozzles of the recording head 34 is performed, the carriage 33 is moved to a home position facing the maintaining and recovering mechanism 81. Then, the image forming apparatus performs the maintaining and recovering operations of capping by the cap member 82 so as to suction the ink liquid from the nozzle, and idle-ejecting to eject the liquid drops which do not contribute to image forming. Thus, the image forming apparatus can provide image forming with stable liquid drop ejecting.

Figure 3:
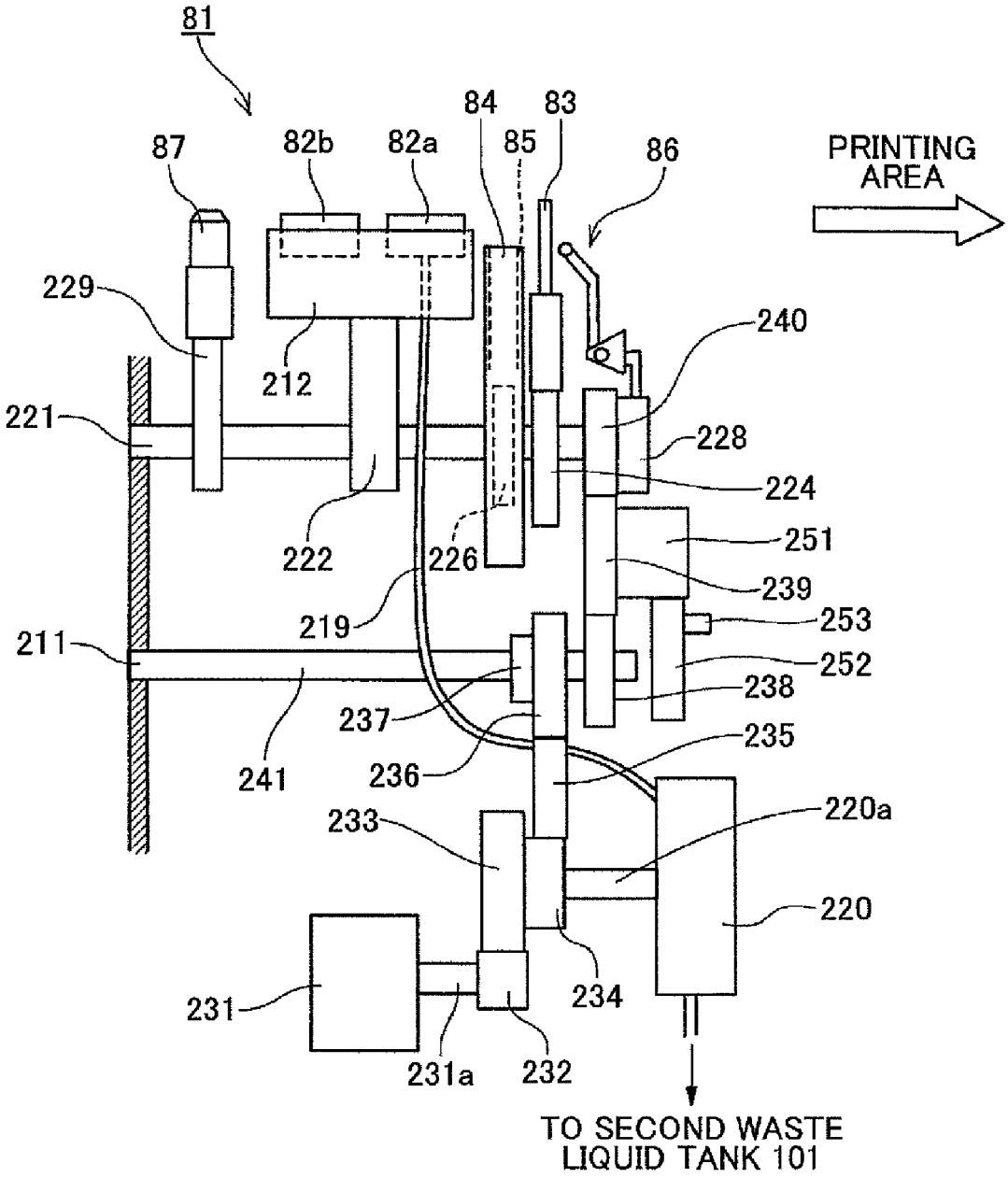
FIG. 3 is a schematic drawing showing a side view of a maintaining and recovering mechanism.
Figure 4:
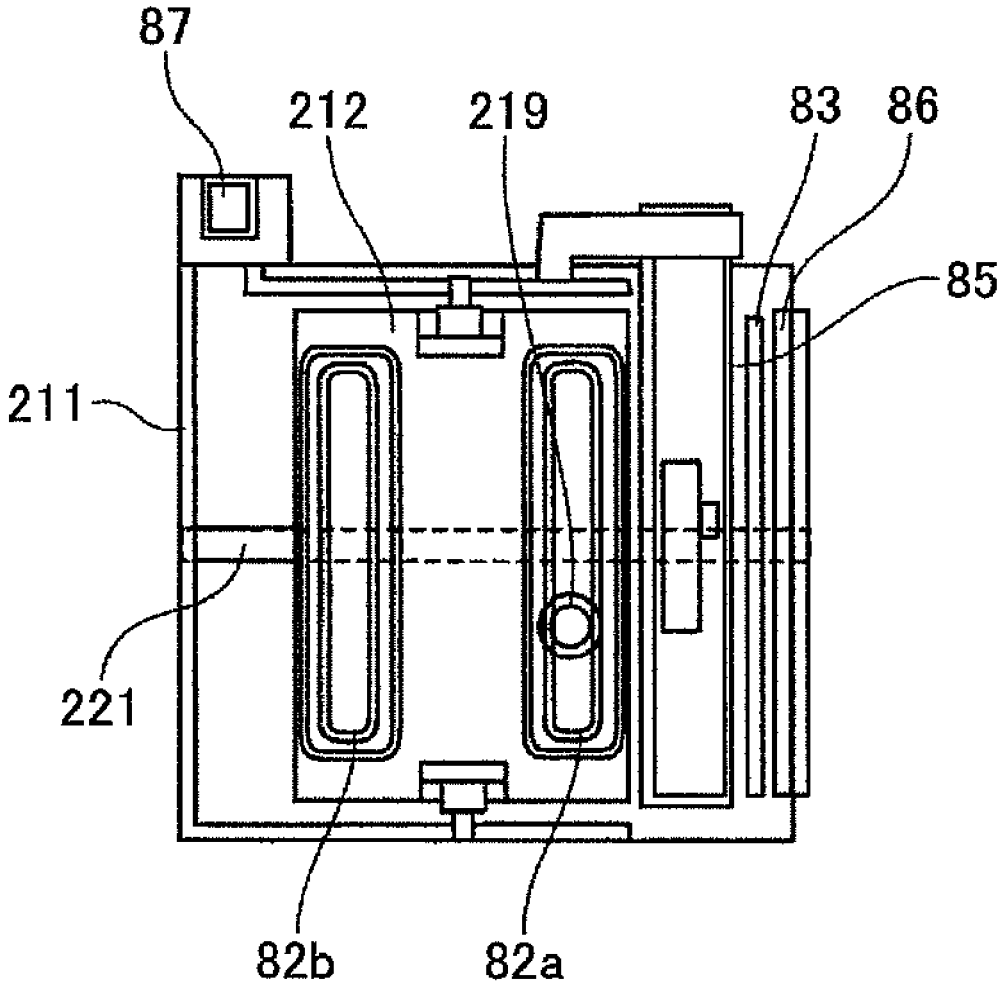
FIG. 4 is a main part plan view of the maintaining and recovering mechanism.

Next, the maintaining and recovering mechanism 81 of the image forming apparatus is described with reference to FIG. 3 and FIG. 4. FIG. 3 is a schematic drawing showing a side view of a maintaining and recovering mechanism 81. FIG. 4 is a main part plan view of the maintaining and recovering mechanism 81.

The maintaining and recovering mechanism 81 includes a maintaining apparatus frame 211, a cap holder 212, the caps 82*a*, 82*b* held by the cap holder 212, the wiper member 83 which includes an elastic member, and a wiper cleaner 86. The cap holder 212, the wiper member 83 and the wiper cleaner 86 are held elevatably, namely, movable upward and downward.

The cap 82 (82*a* or 82*b*) is a box-shaped member having an opening situated at a side facing the nozzle surface of the recording head 34. The cap 82 includes an elastic part provided an upper surface part of the opening. The elastic part comes in contact with and is adhered to the nozzle surface of the recording head 34 so that the opening of the nozzle can be sealed (capped). Furthermore, an absorption member (not shown) made of a porous sponge is provided in the cap 82. With this structure, the ink is evenly held in the cap 82 due to a capillary force of the absorption member. At the same time, a negative pressure created when the ink in the cap 82*a* is discharged by a suction pump 220 can be spread to the entirety of the cap 82.

The idle-eject receiving part 84 is disposed between the wiper member 83 and the cap 82*a*. The cap 82*a* is used for suctioning. A wiper cleaner part 85 is formed as a second wiper cleaner (a wiper cleaning portion of the present invention) in order to scratch and remove the ink attached to the wiper member 83. The wiper cleaning part 85 is formed at a top portion of the idle-eject receiving part 84 on the wiper member 83 side of the idle-eject liquid receiving part 84. The maintaining and restoring mechanism 81 removes the ink attached to the wiper member 83 by actuating the wiper member 83 downward. In particular, as the wiper member 83 is actuated downward, the wiper cleaner 86 cleans the wiper member 83 by pressing the wiper member 83 against the wiper cleaning part 85. Then, the ink removed from the wiper member 83 falls down to the idle-eject receiving part 84.

The suction pump 220 as a vacuum pump is connected to the cap 82*a* via a flexible suction tube 219. The flexible suction tube 219 as a tube member is made of an elastic material. In the illustrated embodiment, the cap 82*a* is disposed closer to the printing area than the cap 82*b*. The cap 82*a* is used as a suctioning (restoring) cap and a moisturizing cap (hereinafter referred to simply as a "suctioning cap"). The cap 82*b* is used as a moisturizing cap. Therefore, when the recovering operation of the recording head 34 is performed, the recording head 34 is selectively moved to a position at which the recording head 34 can be capped by the suctioning cap 82*a*.

The suction pump 220 creates a suction force in the suction tube 219 by repeatedly pressing and moving the suction tube 219 with plural pressing members. The suction tube 219 is connected to the second waste liquid tank 101 via a needle part (not shown) at a downstream side of the suction pump 220.

The suction tube 219 may be a silicon tube. It is preferable that the suction tube 219 be made of a material whereby vapor may not penetrate a tube wall surface because ink is stored in the suction tube 219 for a while. Because of this, in this example, a tube made of thermoplastic elastomer is used as the suction tube 219. As the thermoplastic elastomer, for example, polystyrene thermoplastic elastomer, polyolefin thermoplastic elastomer, polydiene thermoplastic elastomer, polyvinyl chloride thermoplastic elastomer, chlorinated polyethylene thermoplastic elastomer, polyurethane thermoplastic elastomer, polyester thermoplastic elastomer, polyamide thermoplastic elastomer, or fluorine resin thermoplastic elastomer may be used.

In addition, by using the thermoplastic elastomer having hardness of 50 degrees according to JIS-A standard for the suction tube 219, it is possible to obtain an elastic force whereby liquid can be transferred by pumping. Hence, it is possible to reduce the load for pump driving placed on a motor.

Furthermore, by making the vapor penetration rate of the thermoplastic elastomer used for the suction tube 219 to be equal to or less than 15 g/m$^2$·day, it is possible to reduce the speed at which the ink in the tube 219 is evaporated, so that the ink can be stored in the tube 219 for a while.

On the other hand, a camshaft 221 is rotatably supported by the frame 211 underneath the caps 82*a*, 82*b*, and the wiper member 83. A cap cam 222, a wiper cam 224, a roller 226, a cleaner cam 228, and a carriage cam 229 are connected to the camshaft 221, and rotate with the camshaft 221. The cap cam 222 is disposed to actuate the cap holder 212 upward and downward. The wiper cam 224 is disposed to actuate the wiper member 83 upward and downward. The roller 226 is a rotating part where the liquid drops being idle-ejected in the idle-eject receiving part 84 are provided. The cleaner cam 228 is disposed to swing the wiper cleaner 86. The carriage cam 229 is disposed to actuate the carriage lock 87 upward and downward.

The maintaining and recovering mechanism 81 includes a drive mechanism which rotates the camshaft 221 and thereby drives the suction pump 220 as follows. A middle gear 234 of a pump gear 233 is connected to a pump shaft 220*a* of the suction pump 220. The pump gear 233 and the middle gear 234 are formed integrally. The pump gear 233 is engaged with a motor gear 232 which, in turn, is connected to a shaft 231*a* of a motor 231. A middle gear 235 is engaged between the middle gear 234 and a middle gear 236 which is connected to a middle shaft 241 via a one way clutch 237. A middle gear 238 is connected to the middle shaft 241, i.e. the middle gears 236 and 238 are coaxially connected to the middle shaft 241. A middle gear 239 is engaged between the middle gear 238 and a cam gear 240. The cam gear 240 is connected to the camshaft 221. The middle shaft 241, which is a rotation axle of the middle gears 236 and 238, is rotatably supported by the frame 211.

The maintaining and restoring mechanism 81 drives the motor 231 and actuates the wiper member 83 upward via the wiper cam 224 which is connected to the camshaft 221 to remove ink or particles attached to the nozzle surface of the recording head 34. In this removing state, the maintaining and recovering mechanism 81 moves the carriage 33 in the main scanning direction. The wiper member 83 wipes off the ink or the particles attached on the nozzle surface of the recording head 34.

In addition, the longer the nozzle surfaces of the recording head 34 are left uncapped so as to be exposed outside, the greater the likelihood that the ink liquid which remains inside the recording head 34 become thickened or dried so that the ejecting performance of the recording head 34 is decreased. In order to prevent this situation, the maintaining and recovering mechanism 81 caps the nozzle surfaces of the recording head 34 with the caps 82 and thus prevents the ink liquid from becoming thickened or dried, by driving the motor 231 and actuating the caps 82 upward.

Furthermore, during or before/after the recording operations, the ink drops which do not contribute to the recording operations are ejected to the idle-eject receiving part 88 or the cap 82*a* so that the nozzle ejecting capabilities are maintained.

Figure 5:
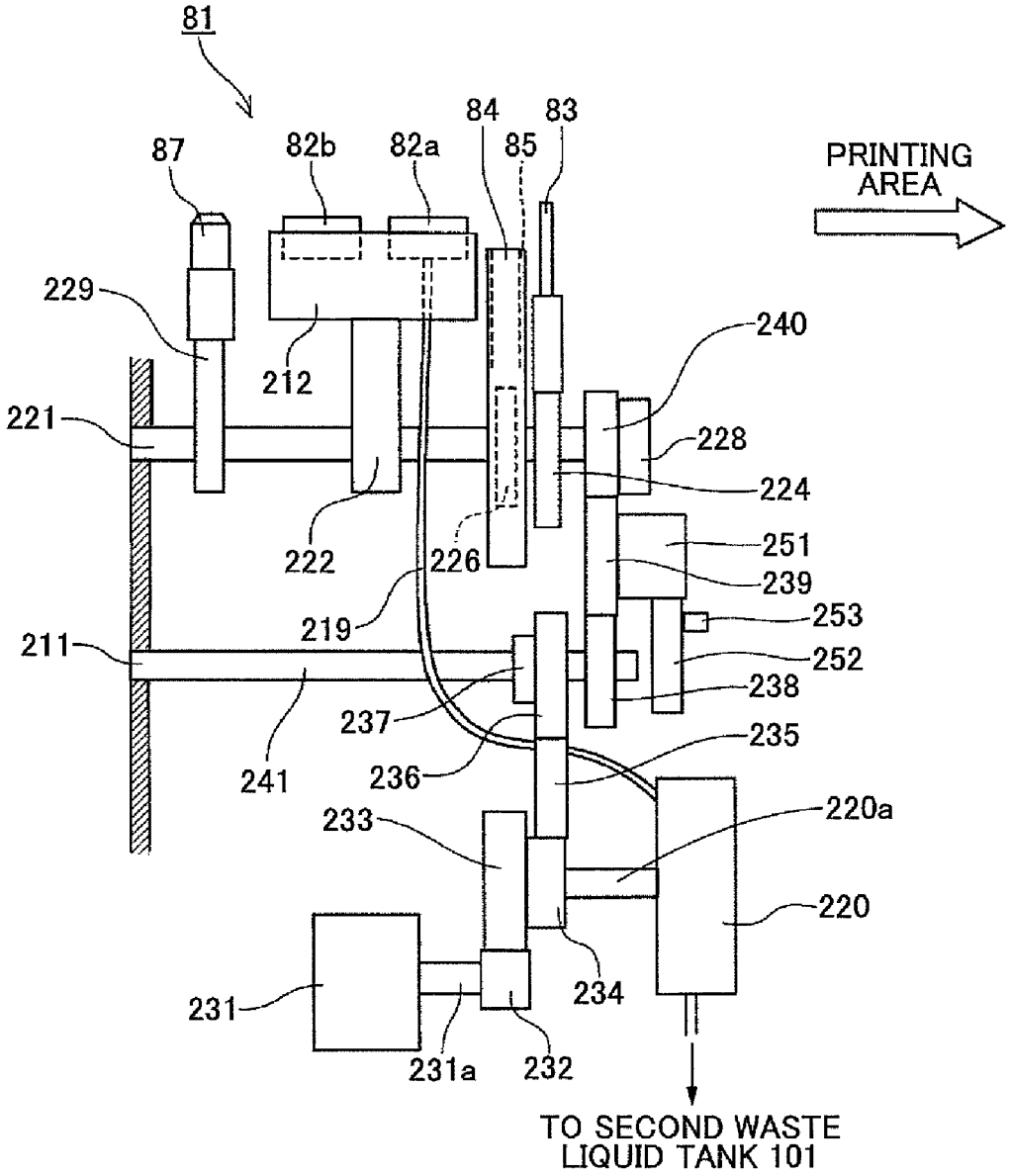
FIG. 5 is a schematic view of a maintaining and recovering mechanism of a first embodiment of the present invention applied to the image forming apparatus.
Figure 6:
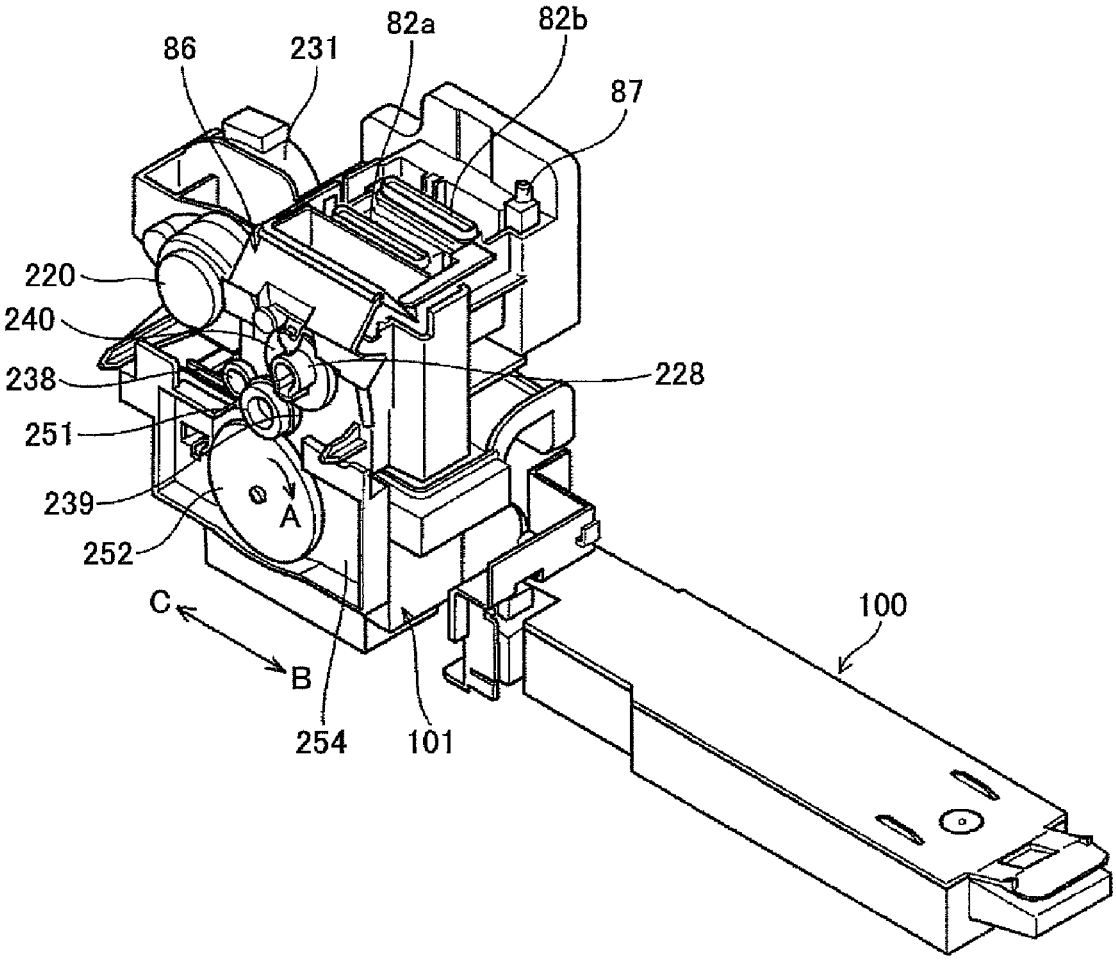
FIG. 6 is a perspective view of the maintaining and recovering mechanism of the first embodiment of the present invention.
Figure 7:
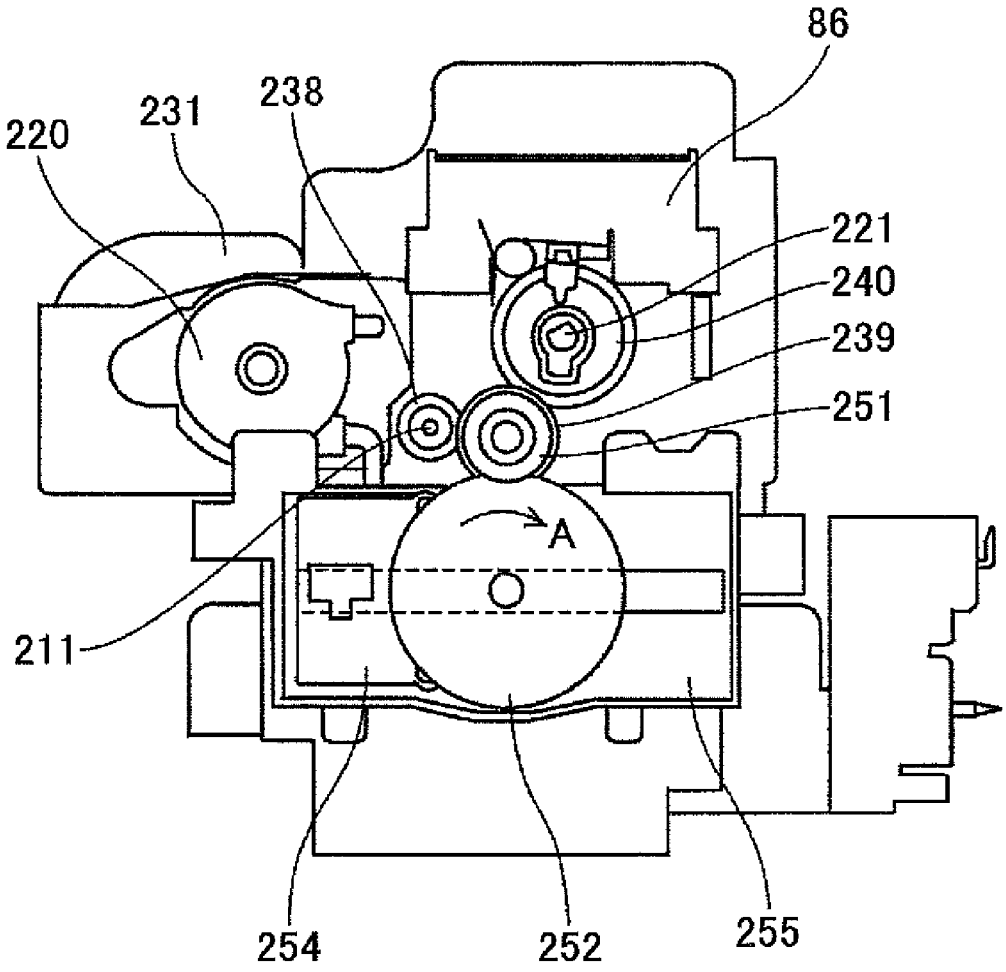
FIG. 7 is a side view of the maintaining and recovering mechanism of the first embodiment of the present invention.
Figure 8:
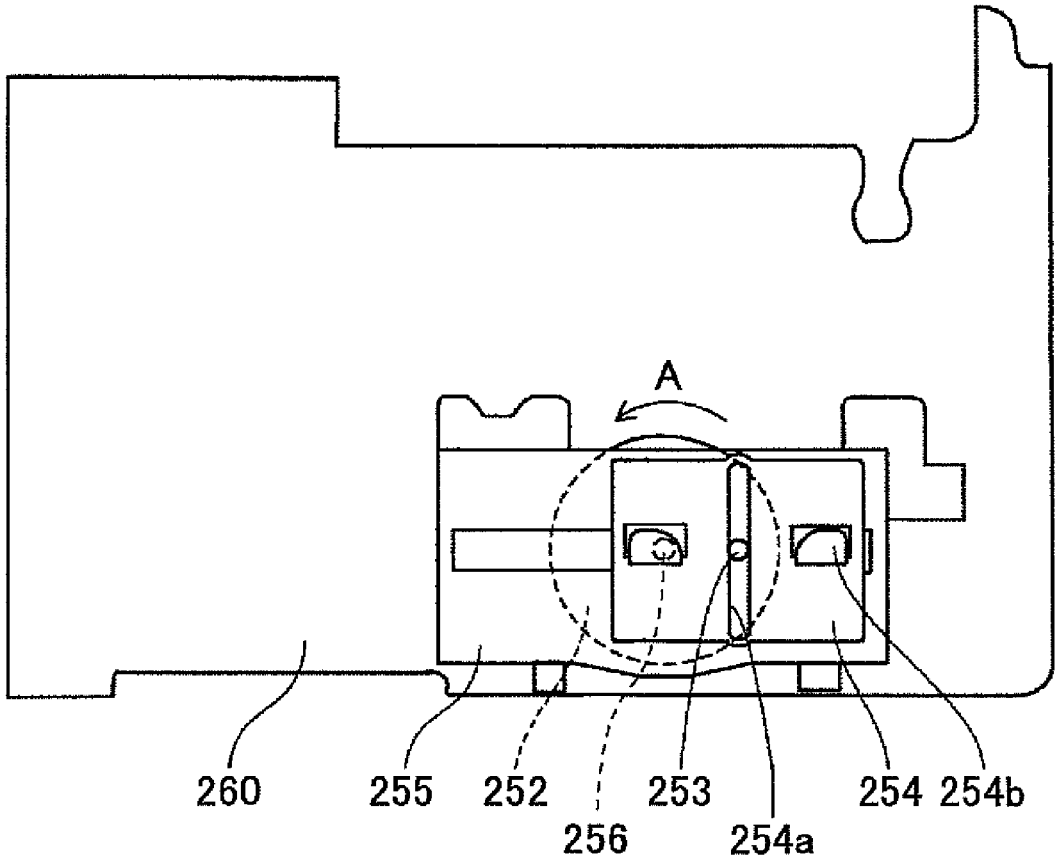
FIG. 8 is a side view of a side plate side configured to hold the maintaining and recovering mechanism of the first embodiment of the present invention.

Next, a maintaining and recovering mechanism including a waste liquid tank applied to an image forming apparatus of a first embodiment of the present invention is discussed with reference to FIG. 5 through FIG. 8. FIG. 5 is a schematic view of a maintaining and recovering mechanism of a first embodiment of the present invention applied to the image forming apparatus. FIG. 6 is a perspective view of the maintaining and recovering mechanism of the first embodiment of the present invention. FIG. 7 is a side view of the maintaining and recovering mechanism of the first embodiment of the present invention. FIG. 8 is a side view of a side plate side configured to hold the maintaining and recovering mechanism of the first embodiment of the present invention.

As discussed above, in this image forming apparatus, the camshaft 221 is rotatably supported by the frame 211 underneath the caps 82*a*, 82*b*. The cap cam 222, the roller 226, and the carriage cam 229 are connected to the camshaft 221, and rotate with the camshaft 221. The cap cam 222 is disposed to actuate the cap holder 212 upward and downward. The roller 226 is a rotating part where the liquid drops being idle-ejected in the idle-eject receiver 84 are provided. The carriage cam 229 is disposed to actuate the carriage lock 87 upward and downward.

In addition, the maintaining and recovering mechanism 81 includes the drive mechanism which rotates the camshaft 221 and thereby drives the suction pump 220 as follows. The middle gear 234 of the pump gear 233 is connected to the pump shaft 220*a* of the suction pump 220. The pump gear 233 and the middle gear 234 are formed integrally. The pump gear 233 is engaged with the motor gear 232 which, in turn, is connected to the shaft 231*a* of the motor 231. The middle gear 235 is engaged between the middle gear 234 and the middle gear 236 which is connected to the middle shaft 241 via the one way clutch 237. The middle gear 238 is connected to the middle shaft 241, i.e. the middle gears 236 and 238 are coaxially connected to the middle shaft 241. The middle gear 239 is engaged between the middle gear 238 and the cam gear 240. The cam gear 240 is connected to the camshaft 221. The middle shaft 241, which is the rotation axle of the middle gears 236 and 238, is rotatably supported by the frame 211.

On the other hand, a slide cover 255 is provided to the frame 211 of the maintaining and recovering mechanism 81 and a sub-side plate 260. The sub-slide plate 260 is configured to rotatably support a conveyance roller 252 and a cam pin 253. A slider member 254 is slidably supported at the slide cover 255 by a guide groove (not shown) formed in the slide cover 255 and a pin member (not shown) provided at the slider member 254. A moving direction of the slider member 254 is a direction along the sub-scanning direction (front and back directions of the apparatus main body).

The first waste liquid tank 100 is engaged with and supported by an engaging part 254*b* of the slider member 254 so that the first waste liquid tank 100 can be moved in the front and back directions of the apparatus main body, namely directions between the front surface and the rear surface: directions indicated by arrows B and C in FIG. 6.

In addition, as a part configured to move the first waste liquid tank 100 in response to moving of the cap 82*a*, intermediate gears 251 and 252 are provided. The intermediate gear 251 is provided with the intermediate gear 239 being rotated when the cap 82*a* is moved upward or downward. The intermediate gear 252 having the cam pin 253 is engaged with the intermediate gear 251. The intermediate gear 252 is rotatably supported at the sub-side plate 260 by a spindle 256. The cam pin 253 of the intermediate gear 252 is slidably engaged with the slide groove 254*a* of the slider member 254.

Here, the number of teeth of the cam gear 240, the intermediate gear 239, the intermediate gear 251 and the intermediate gear 252 with the cam pin 253 are selected so that the number of rotations of the camshaft 221 configured to move the cap 82*a* upward and downward and the number of rotations of the intermediate gear 252 with the cam pin 253 are different.

Under this structure, when the camshaft 221 is rotated via the intermediate gear 239 and the cam gear 240 by driving the motor 231 so that the cap 82*a* is moved upward or downward, the intermediate gear 239 is rotated in a direction indicated by an arrow A so that the cam pin 253 of the intermediate gear 252 slides in the slide groove 254*a* of the slider member 254. As a result of this, the slider member 254 reciprocally moves in the guide groove (not shown) of the slider cover 255 in the directions indicated by the arrows B and C and thereby the first waste liquid tank 100 held by the slider member 254 is also reciprocally moved in the same directions.

In other words, in the maintaining and recovering mechanism 81, the motor 231 is normally rotated so that the motor shaft 231*a*, the motor gear 232, the pump gear 233, the intermediate gear 234, and the intermediate gears 235 and 236 are rotated and the shaft 220*a* of the suction pump 220 is rotated. As a result of this, the suction pump 220 is operated and an inside of the cap 82*a* is suctioned. Rotation of other gears such as the gear 238 is blocked by the one-way clutch 237.

On the other hand, if the motor 231 is rotated in reverse, the one-way clutch 237 is engaged. As a result of this, the rotation of the motor 231 is transmitted to the cam gear 240 via the motor shaft 231*a*, the motor gear 232, the pump gear 233, the intermediate gear 234, and the intermediate gears 235, 236, 238 and 239, so that the camshaft 221 is rotated. Simultaneously, the rotation of the motor 231 is transmitted to, in this order, the motor shaft 231*a*, the motor gear 232, the pump gear 233, the intermediate gear 234, the intermediate gears 235, 236, 238 and 239 (251), and the intermediate gear 252 with the cam pin 253 so that the first waste liquid tank 100 is moved.

The suction pump 220 is not operated by reversing the rotation of the pump shaft 220*a*. Each of the cap cams 222A and 222B (cap cam 222) goes upward and downward at a designated timing by the rotation of the camshaft 221 and the cap 82*a* is moved to a position where the nozzle surface of the recording head 34 is sealed and opened. Here, although the movement of the cap 82*a* is discussed as "go upward and downward" in this example, the present invention is not limited to this example. As long as the cap 82*a* is moved between the positions where the recording head is sealed and opened, there is no limitation of the movement of the cap 82*a*.

Figure 9:
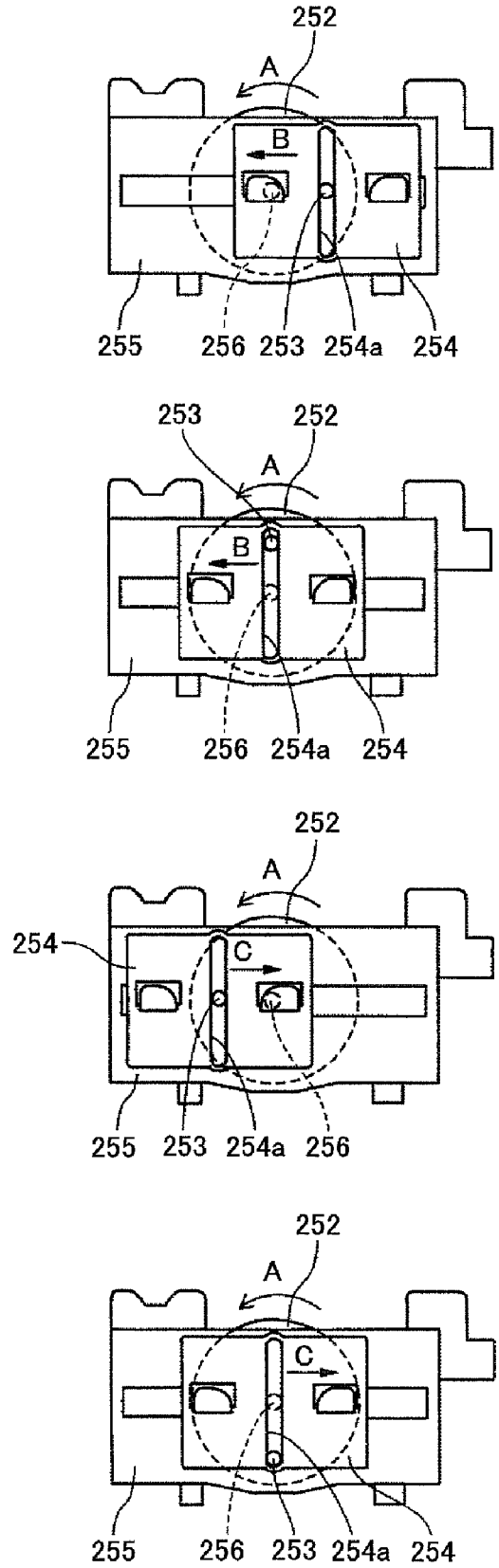
FIG. 9 is a view for explaining an operation of the maintaining and recovering mechanism of the first embodiment of the present invention.

Accordingly, in a case where the number of the teeth of the intermediate gear 252 is set so that ¼ rotation of the intermediate gear 252 is made during a single rotation of the camshaft 221 (a single movement upward and downward of the cap 82*a*), when the cap 82*a* is the sealing position and the slider member 254 is situated in a position shown in FIG. 9(*a*), if the cap 82*a* is moved to the sealing position again after the cap 82*a* is moved from the sealing position to the opening position, the slider member 254 is moved to a position shown in FIG. 9(*b*). If the cap 82*a* is further moved to the sealing position again after the cap 82*a* is moved from the sealing position to the opening position, the slider member 254 is moved to a position shown in FIG. 9(*c*). If the cap 82*a* is further moved to the sealing position again after the cap 82*a* is moved from the sealing position to the opening position, the slider member 254 is moved to a position shown in FIG. 9(*d*). If the cap 82*a* is further moved to the sealing position again after the cap 82*a* is moved from the sealing position to the opening position, the slider member 254 is moved to a position shown in FIG. 9(*a*).

Figure 10:
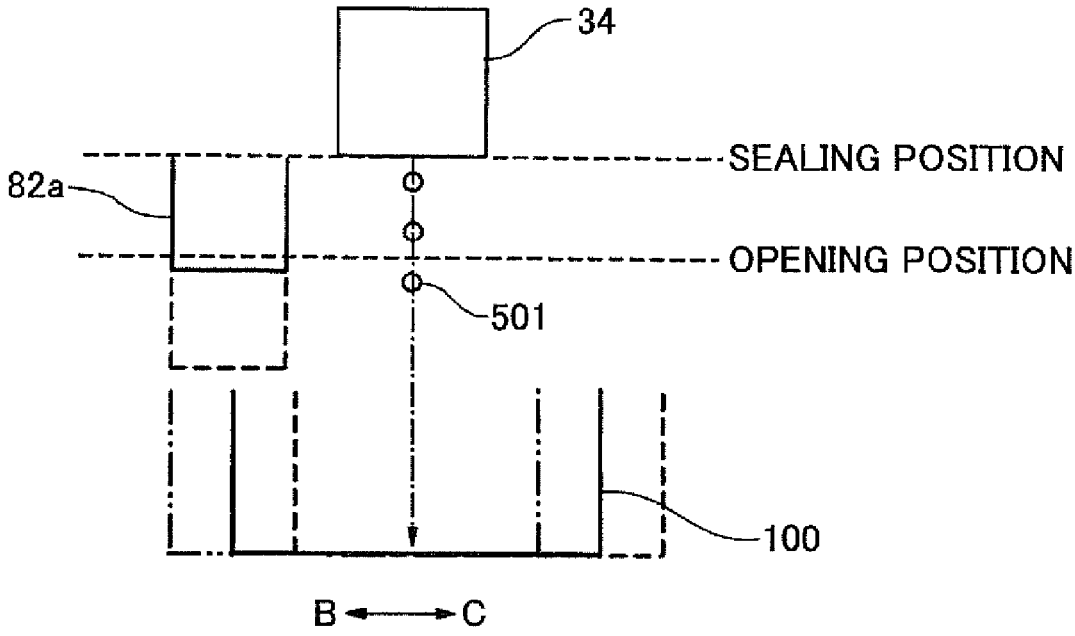
FIG. 10 is a view for explaining movement of a cap and movement of a first waste liquid tank.

By movement of the slider member 254, the first waste liquid tank 100 held by the slider member 254 is also moved. Accordingly, as shown in FIG. 10, since the first waste liquid tank 100 is moved in the directions indicated by the arrows B and C by the upward and downward movement (not limited to "upward and downward") of the cap 82*a* so that the positions of the cap 82*a* are changed, a discharge position of the waste liquid of liquid drops 501 from the recording head 34 which drops do not contribute to the image forming is changed. As a result of this, it is possible to scatter the waste liquid stack.

In other words, in this image forming apparatus, when printing data are input to the image forming apparatus, the cap 82*a* which is at the sealing position so as to seal the recording head 34 is moved to the opening position. In order to discharge the thickened ink by the nozzles of the recording head 34 to the idle-eject receiving part 84 at the time of capping (sealing), the printing operation is performed after the idle-ejecting is performed.

Figure 11:
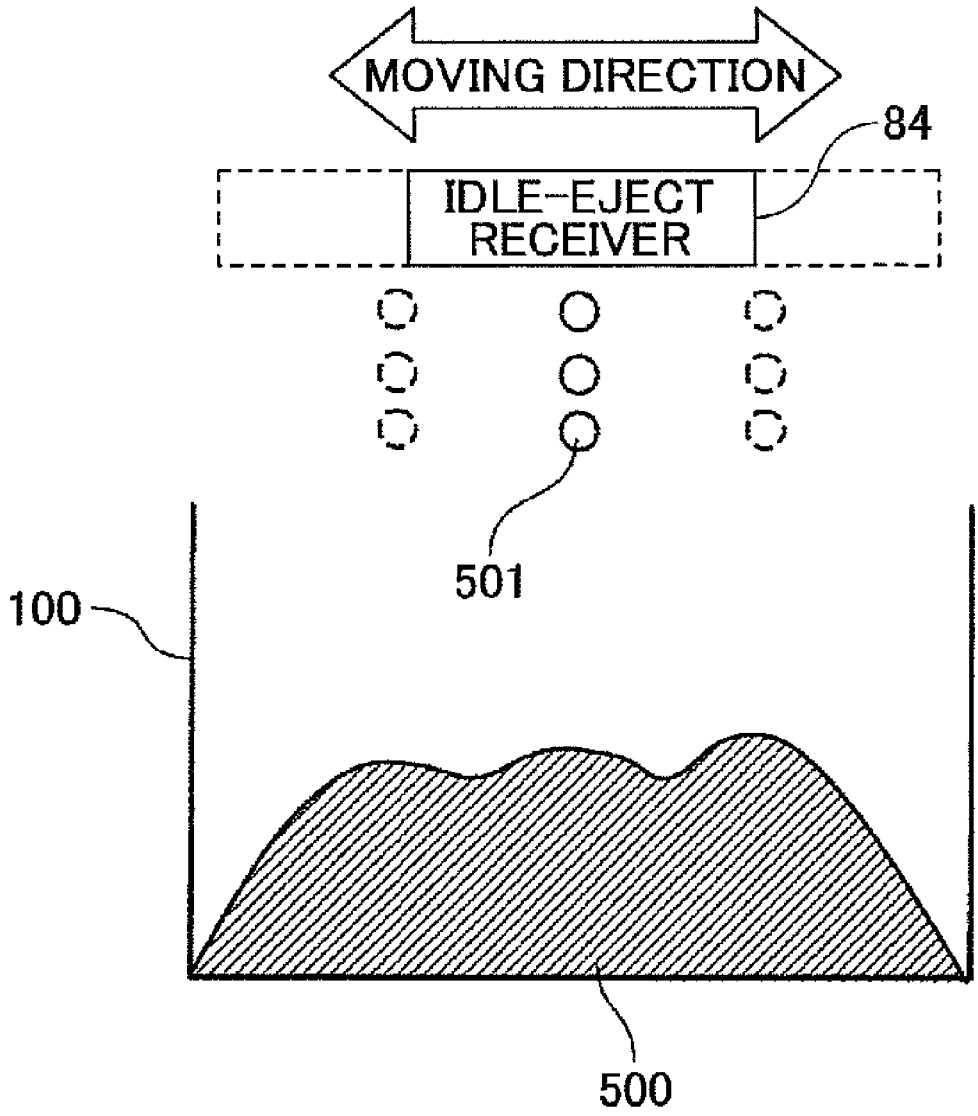
FIG. 11 is a view for explaining the operation of the maintaining and recovering mechanism of the first embodiment of the present invention.
Figure 12:
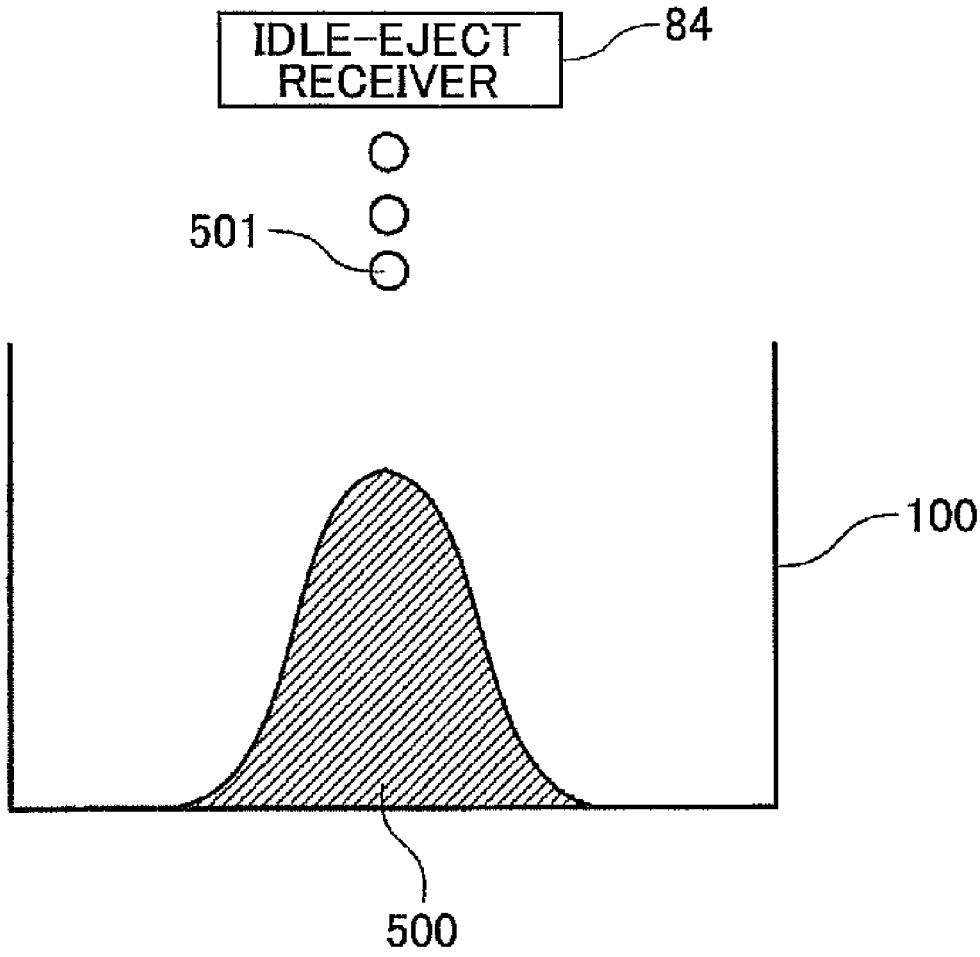
FIG. 12 is a view for explaining a case where a first waste liquid tank is not moved.

At this time, since the first waste liquid tank 100 is moved a designated amount tied to the movement of the cap 82*a*, the first waste liquid tank 100 can be moved when the cap 82*a* is moved from the sealing position to the opening position (a position separated from the recording head 34) before the waste liquid is discharged due to the idle-ejecting prior to printing. Accordingly, as shown in FIG. 11, the discharging position of the liquid drops 501 being the waste liquid from the idle-eject receiver 84 to the first waste liquid tank 100 is changed so that it is possible to scatter the stacking positions of the waste liquid (thickened ink) 500 in the first waste liquid tank 100. When the first waste liquid tank 100 is not moved, the thickened ink 500 is stacked in the same position so as to increase in height as shown in FIG. 12.

In addition, the idle-eject operation of the recording head is performed not only before printing but also after the head suction is performed in order to remove the thickened ink adhered to the nozzle of the recording head 34 and the nozzle surface is wiped by the wiper member 83.

At this time, the cap 82*a* is in a position where the recording head 34 is sealed at the time of head suction. By moving the cap 82*a* to the opening position relative to the recording head 34 before the wiping, the first waste liquid tank 100 can be moved just before the idle-ejecting. Hence, it is possible to scatter the stacking positions of the thickened liquid.

In addition, it is preferable to use not the torque of the suction pump 220 but the torque of the camshaft 221 configured to move the cap 82*a* upward and downward in order to move the first waste liquid tank 100.

In other words, since the waste liquid is discharged to the first waste liquid tank 100, the weight of the first waste liquid tank 100 is increased so that a moving load is increased. Due to the increase of the moving load, the suction capabilities of the suction pump 220 may be changed. In addition, since the load of the suction pump 220 is large, if the moving load of the first waste liquid tank 100 is added, the load applied to the motor 231 is increased. On the other hand, although a motor (driving source) exclusively for moving the first waste liquid tank 100 may be used, the cost may be increased while the freedom degree of control is also increased.

Thus, by making a structure where the waste liquid tank 100 is moved tied with the movement of the cap member 82*a* and a position of the waste liquid tank 100 in a case of idle-ejection being performed from the recording head last time and a position of the waste liquid tank in a case of idle-ejection being performed from the recording head this time are different, the discharging position of the waste liquid relative to the waste liquid tank 100 is changed so that the growth in height of the stacking material can be reduced. Hence, it is possible to extend the service life time of the waste liquid tank 100 without making the height of the image forming apparatus higher.

Here, the relationship of the numbers of rotations of the cam gear 240 and the intermediate gear 252 with the cam pin 253 is discussed. As discussed above, the number of the rotations of the cam gear 240 is different from that of the intermediate gear 252 with the cam pin 253.

In other words, in this image forming apparatus, when the printing operation ends, in order to prevent the nozzle surface of the recording head 34 from being dried, the cap 82*a* stops in the sealing position where the recording head 34 is sealed. Because of this, in a case where the operation such as printing is performed, the number of rotations of the cap cams 222A and 222B becomes "n (n: integer)".

At this time, if the number of the rotations of the cam gear 240 is the same as the number of the rotations of the intermediate gear 252 with the cam pin 253, when the image forming apparatus stops, the first waste liquid tank 100 stops in the same position. In this case, substantially as well as the case where the first waste liquid tank 100 stops as shown in FIG. 12, the stack cannot be scattered efficiently.

Because of this, as discussed above, by making the number of the rotations of the cam gear 240 and the number of the rotations of the intermediate gear 252 with the cam pin 253 be different from each other, the stopping position of the first waste liquid tank 100 can be changed when the first waste liquid tank 100 is moved tied to the movement of the cap 82*a*.

Because of this, the first waste liquid tank 100 is moved from the first position to the second position when the cap 82*a* is moved to the sealing position again after being moved to the opening position, where a position of the first waste liquid tank 100 is a first position when the cap 82*a* is situated in the sealing position. Based on the relationship of the numbers of the rotations of the cam gear 240 and the intermediate gear 252 with the cam pin, the second position becomes the first position when the cap 82*a* is moved next time. The first waste liquid tank 100 is moved to a new second position based on the movement of "sealing position→opening position→sealing position" of the cap 82*a*. See FIG. 9.

Here, the number of reciprocal operations from the sealing position to the opening position of the cap 82*a* is not always one due to the printing operation or maintenance operation. Accordingly, it is preferable that the least common multiple of the number of the rotations of the cam gear 240 and the number of the rotations of the intermediate gear 252 with the cam pin 253 be larger.

For example, in a case where the number of the teeth of the cam gear 240 is 52, the number of the teeth of the intermediate gear 239 is 35, the number of the teeth of the intermediate gear 251 is 15, and the number of the teeth of the intermediate gear 252 with the cam pin 253 is 43, when the cam gear 240 is rotated once, the intermediate gear 252 with the cam pin 253 is rotated $(52/35)\times(15/43)=156/301$ rotations. In this case, the position of the first waste liquid tank 100 is the same every 301 cycles of the cam gear 240. The cycle at which the first waste liquid tank 100 is in the same position in a case where the least common multiple is greater becomes longer than that in a case where the least common multiple is smaller so that the discharge positions of the waste liquid can be scattered.

Figure 13:
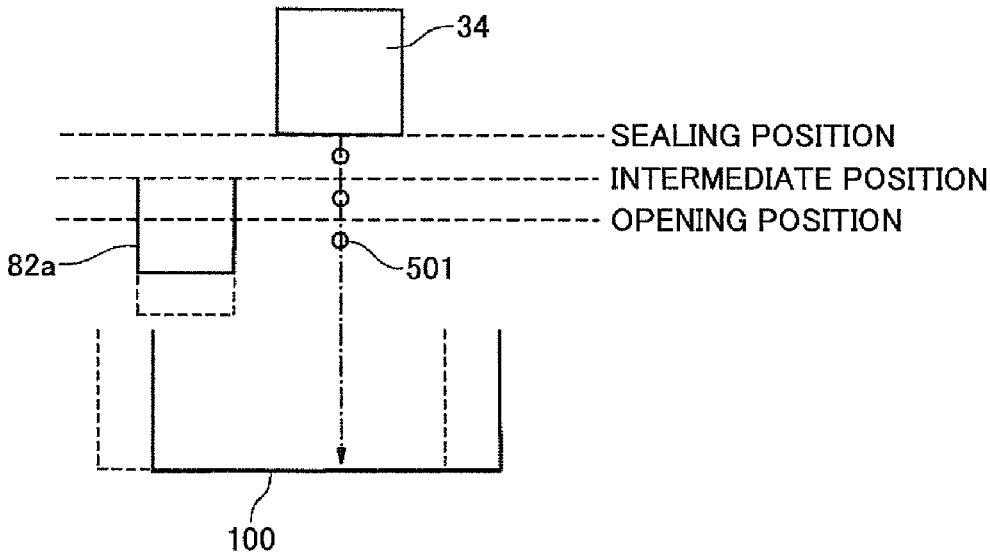
FIG. 13 is a view for explaining a second embodiment of the present invention applied to the image forming apparatus.
Figure 14:
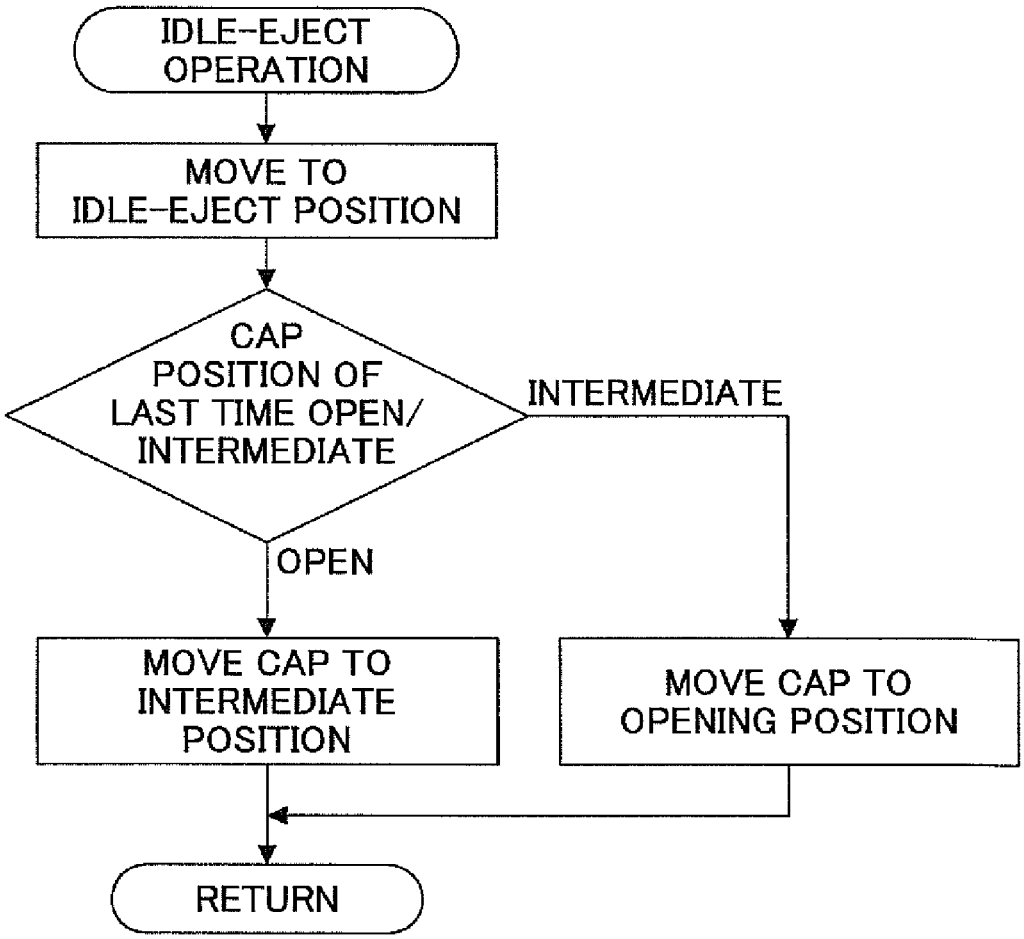
FIG. 14 is a flowchart for explaining the second embodiment of the present invention.

Next, the maintaining and recovering mechanism including the waste liquid tank applied to an image forming apparatus of a second embodiment of the present invention is discussed with reference to FIG. 13 and FIG. 14. FIG. 13 is a view for explaining the second embodiment of the present invention applied to the image forming apparatus. FIG. 14 is a flowchart for explaining the second embodiment of the present invention.

In this embodiment, as shown in FIG. 13, a single (or plural) intermediate position as a stopping position of the cap 82*a* is provided between the sealing position where the nozzle surface of the recording head 34 is sealed and the opening position where the nozzle surface is opened, so that three or more stopping positions are provided.

In FIG. 13, an example where the liquid drops 501 being the waste liquid are directly discharged from the recording head 34 is illustrated. However, this example is illustrated for explaining the positional relationship between the cap 82*a* and the recording head 34. This does not mean that the idle-ejecting is performed from the recording head 34 to the idle-eject receiving part 84 and all of the liquid drops 501 being the waste liquid are directly discharged to the first waste liquid tank 100. This example is applied to other embodiments and therefore explanation thereof in the other embodiments is omitted.

As shown in FIG. 14, when the idle-eject, operation is performed, after the recording head 34 is moved to the idle-eject position, the position of the cap 82*a* of the last time is determined. In a case where the idle-eject operation of last time has been performed with the cap 82*a* situated in the opening position, the idle-eject operation of this time is performed by moving the cap 82*a* to the intermediate position. In a case where the idle-eject operation of last time has been performed with the cap 82*a* situated in the intermediate position, the idle-eject operation of this time is performed by moving the cap 82*a* to the opening position.

With this structure, in this example compared to a case where there are only two positions, the sealing position and the opening position, as the stopping positions of the cap 82*a*, even if the discharge position of the waste liquid cannot be scattered to two positions due to, for example, the limitation of lay-out, it is possible to scatter the stacking positions of the thickened ink.

Figure 15:
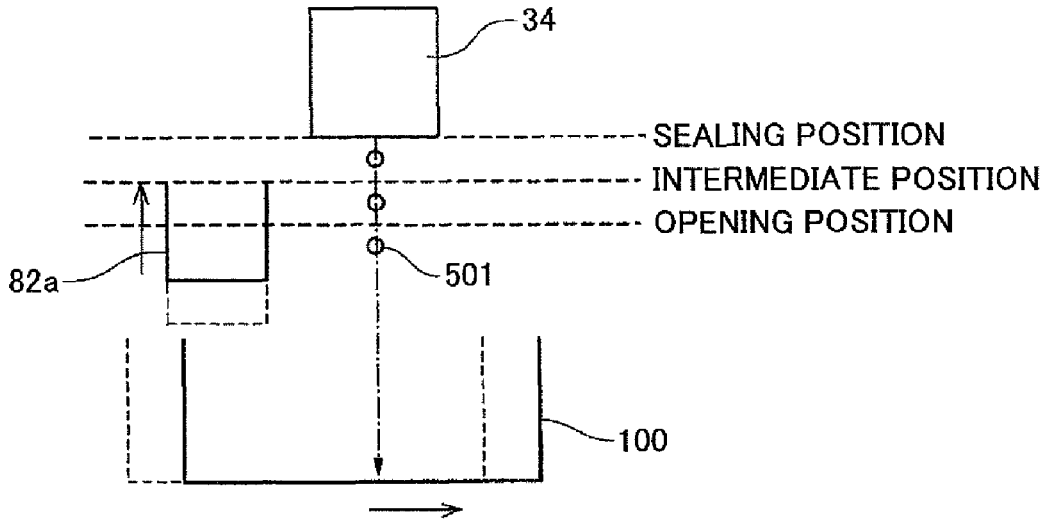
FIG. 15 is a view for explaining a third embodiment of the present invention applied to the image forming apparatus.

Next, the maintaining and recovering mechanism including the waste liquid tank applied to an image forming apparatus of a third embodiment of the present invention is discussed with reference to FIG. 15. Here, FIG. 15 is a view for explaining the third embodiment of the present invention applied to the image forming apparatus.

In this embodiment, as well as the second embodiment, a single (or plural) intermediate position as a stopping position of the cap 82*a* is provided between the sealing position where the nozzle surface of the recording head 34 is sealed and the opening position where the nozzle surface is opened, so that three or more stopping positions are provided. In this embodiment, during the idle-ejecting of the recording head 34, the cap 82*a* is moved from the opening position to the intermediate position. With this structure, in this embodiment as well as the second embodiment, the discharge positions of the waste liquid can be scattered so that the stacking positions of the thickened ink can be scattered.

Figure 16:
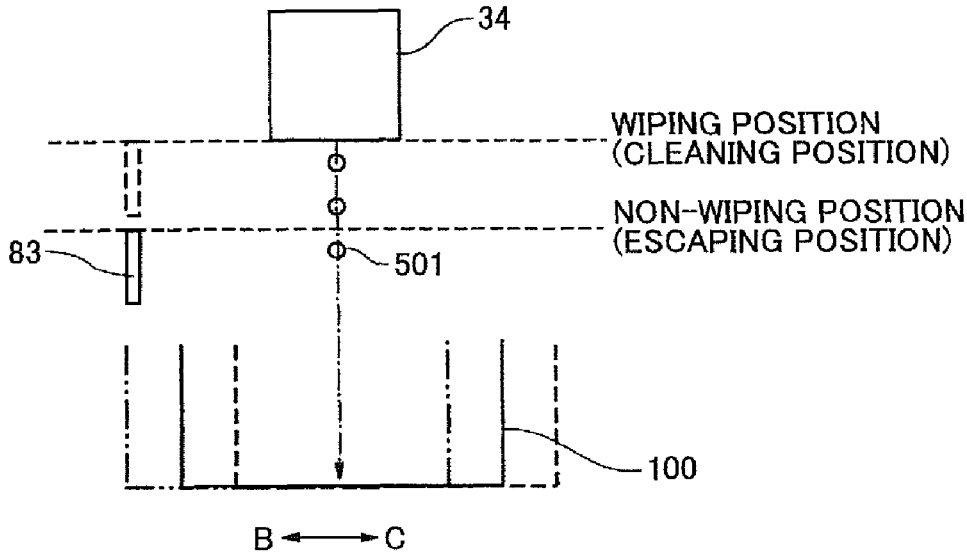
FIG. 16 is a view for explaining a fourth embodiment of the present invention applied to the image forming apparatus.

Next, the maintaining and recovering mechanism including the waste liquid tank applied to an image forming apparatus of a fourth embodiment of the present invention is discussed with reference to FIG. 16. FIG. 16 is a view for explaining the fourth embodiment of the present invention applied to the image forming apparatus.

As shown in FIG. 16, the wiper member 83 configured to wipe the nozzle surface of the recording head 34 is moved between a cleaning position (wiping position) where the nozzle surface of the recording head 34 is wiped and an escaping position (non-wiping position) being separated from the nozzle surface.

The wiper member 83 is moved by the camshaft 221 configured to move the cap 82*a*. Hence, in this embodiment, as discussed in the first embodiment, the first waste liquid tank 100 moved by the intermediate gear 252 with the cam pin 253 where a driving force (torque) is transmitted from the intermediate gear 239 provided at a first stage of the camshaft 240 is moved tied to the movement between the wiping position and the escaping position. In other words, a part configured to move the first waste liquid tank 100 tied to the movement of the cap 82*a* forms a part configured to move the first waste liquid tank 100 tied to the movement of the wiper member 83.

Thus, by moving the first waste liquid tank 100 tied to the movement of the wiper member 83, the discharge position of the waste liquid due to the idle-eject is changed. In other words, the wiping operation is performed after the head suction is performed in order to remove the thickened ink adhered to the nozzle holes of the recording head 34. Accordingly, it is possible to scatter the stacking positions of the stacking material due to the thickened ink by moving the first waste liquid tank 10*o* just before the idle-ejecting.

In this example, the wiper member 83 is moved upward and downward. However, the present invention is not limited to this example. As long as the wiper member 83 is moved between the wiping position and the non-wiping position, it is possible to apply the embodiments of the present invention.

Thus, the waste liquid tank 100 is moved tied with movement of the wiper member 83. A position of the waste liquid tank 100 in a case of idle-ejection being performed from the recording head last time and a position of the waste liquid tank 100 in a case of idle-ejection being performed from the recording head this time are different. Hence, the discharging position of the waste liquid relative to the waste liquid tank is changed so that the growth of the height of the stacking material can be reduced. Hence, it is possible to extend the service life time of the waste liquid tank 100 without making the height of the image forming apparatus high.

In this image forming apparatus, since the wiper member 83 and the cap 82 are moved by the same driving source (motor 220) and the camshaft 221, the same explanation as that of the first embodiment can be applied to this embodiment. However, even if the wiper member 83 and the cap 82*a* are driven by different driving sources, it is possible to apply the embodiments of the present invention.

In other words, by making the numbers of rotations of the camshaft 240 and the intermediate gear 252 with the cam pin 253 different from each other, a designated relationship state is set.

When the wiper member 83 is in the wiping position, the first waste liquid tank 100 is in the first position. When the wiper member 83 is moved to the wiping position again after the wiper member 83 is moved to the non-wiping position in the above-mentioned state, the first waste liquid tank 100 can be moved to the second position different from the first position.

Alternatively, when the wiper member 83 is in the non-wiping position, the first waste liquid tank 100 is in the first position. When the wiper member 83 is moved to the non-wiping position again after the wiper member 83 is moved to the wiping position in the above-mentioned state, the first waste liquid tank 100 can be moved to the second position different from the first position.

Figure 17:
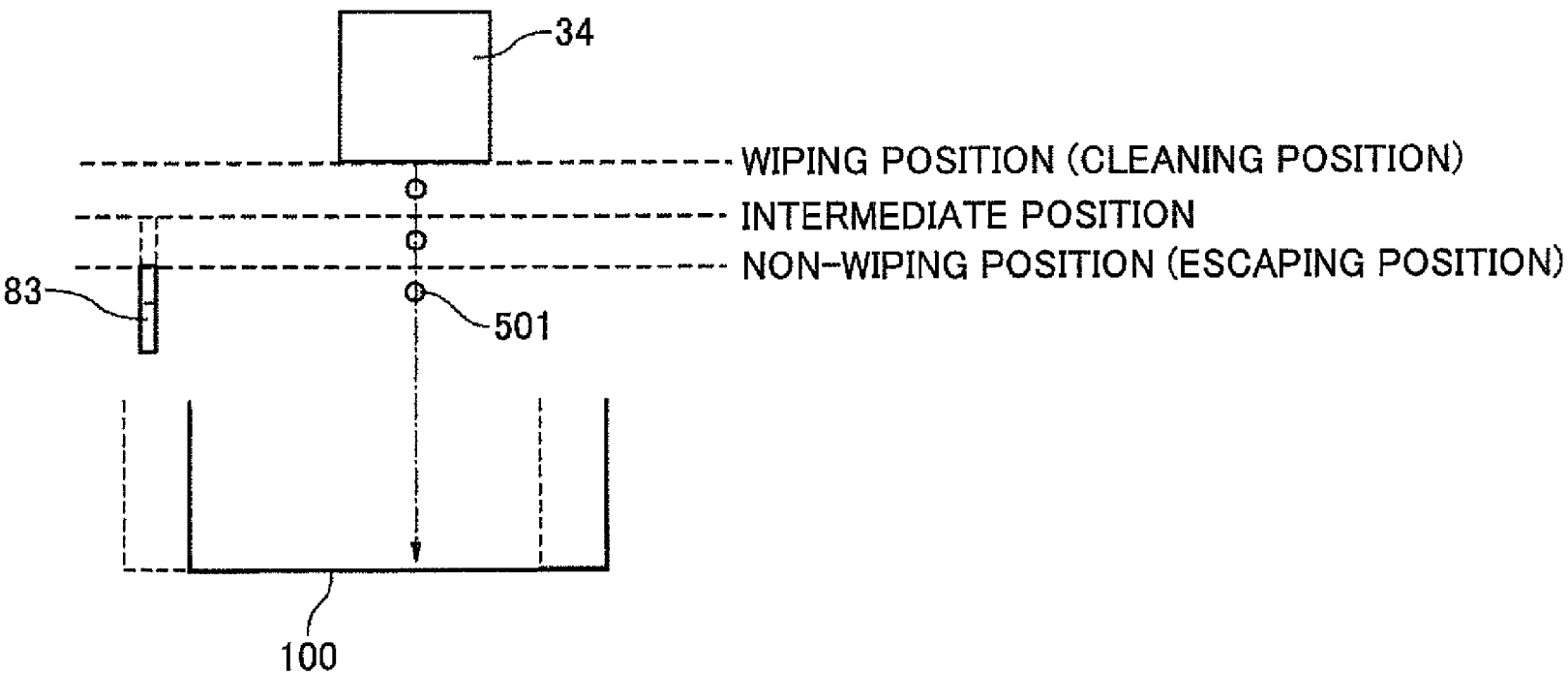
FIG. 17 is a view for explaining a fifth embodiment of the present invention applied to the image forming apparatus.
Figure 18:
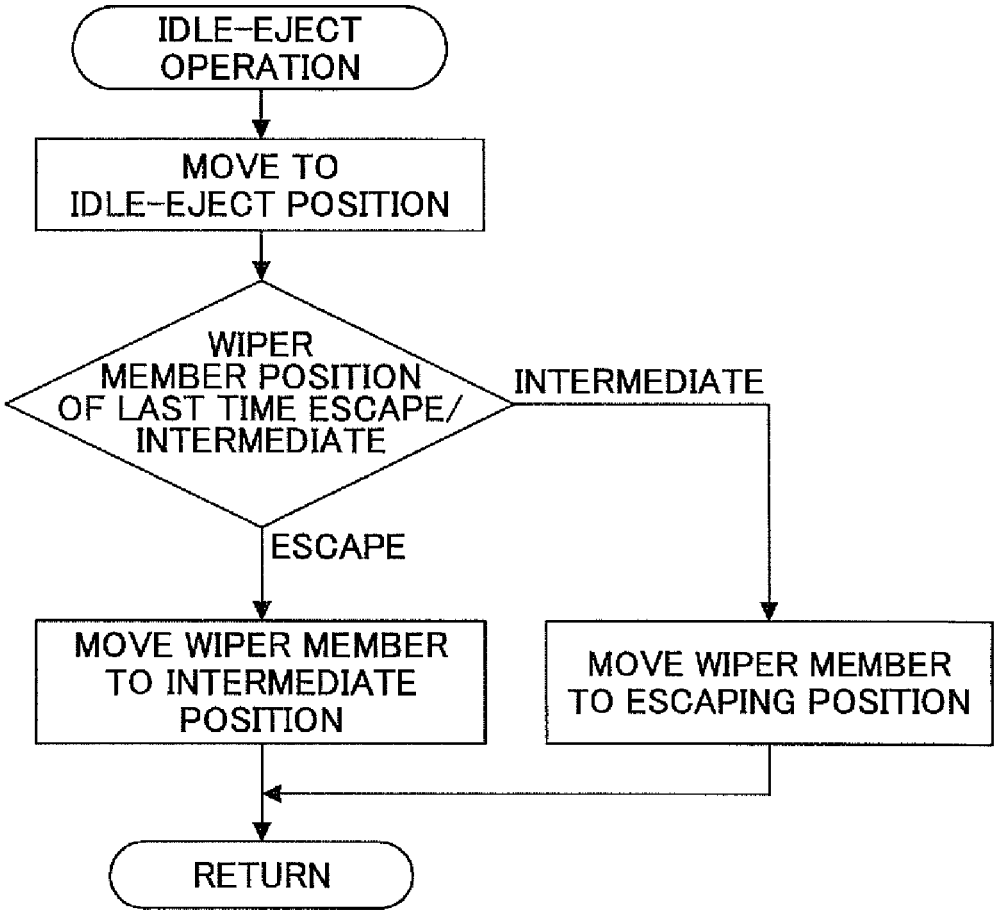
FIG. 18 is a flowchart for explaining the fifth embodiment of the present invention.

Next, the maintaining and recovering mechanism including the waste liquid tank applied to an image forming apparatus of a fifth embodiment of the present invention is discussed with reference to FIG. 17 and FIG. 18. Here, FIG. 17 is a view for explaining the fifth embodiment of the present invention applied to the image forming apparatus. FIG. 18 is a flowchart for explaining the fifth embodiment of the present invention.

In this embodiment, as shown in FIG. 17, a single (or plural) intermediate position as a stopping position of the wiper member 83 is provided between the wiping position (cleaning position) where the nozzle surface of the recording head 34 is wiped and the non-wiping position (escaping position) separated from the nozzle surface, so that three or more stopping positions are provided.

As shown in FIG. 18, when the idle-eject operation is performed, after the recording head 34 is moved to the idle-eject position, the position of the wiper member 83 of the last time is determined.

In a case where the idle-eject operation of last time has been performed with the wiper member 83 situated in the escaping position, the idle-eject operation of this time is performed by moving the wiper member 83 to the intermediate position. In a case where the idle-eject operation of last time has been performed with the wiper member 83 situated in the intermediate position, the idle-eject operation of this time is performed by moving the wiper member 83 to the escaping position (non-wiping position).

With this structure, in this example compared to a case where there are only two positions, the wiping position and the non-wiping position, as the stopping positions of the wiper member 83, even if the discharge position of the waste liquid cannot be scattered to two positions due to, for example, the limitation of lay-out, it is possible to scatter the stacking positions of the thickened ink.

Figure 19:
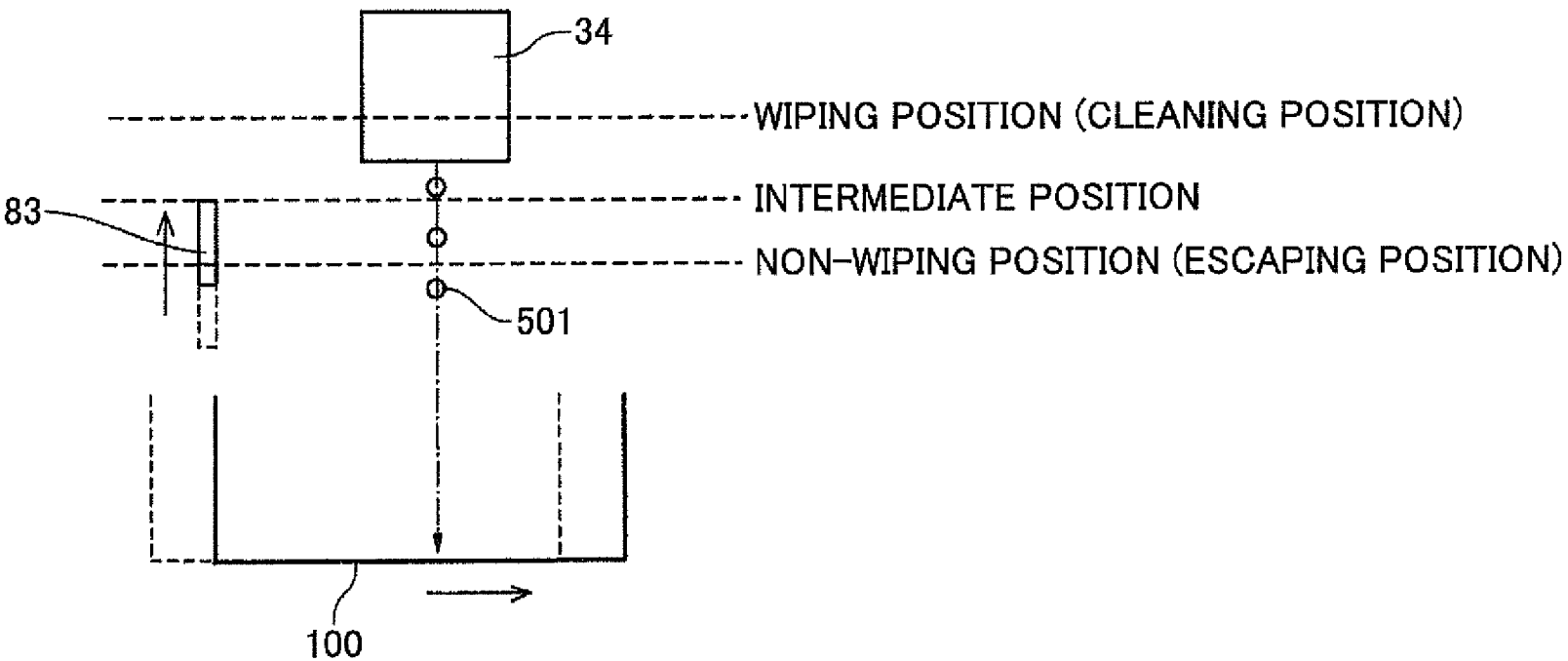
FIG. 19 is a view for explaining a sixth embodiment of the present invention applied to the image forming apparatus.

Next, the maintaining and recovering mechanism including the waste liquid tank applied to an image forming apparatus of a sixth embodiment of the present invention is discussed with reference to FIG. 19. Here, FIG. 19 is a view for explaining the sixth embodiment of the present invention applied to the image forming apparatus.

In this embodiment, as well as the fifth embodiment, a single (or plural) intermediate position as a stopping position of the wiper member 83 is provided between the wiping position (cleaning position) where the nozzle surface of the recording head 34 is wiped and the non-wiping position (escaping position) separated from the nozzle surface, so that three or more stopping positions are provided. In this embodiment, during the idle-eject of the recording head 34, the wiper member 83 is moved from the non-wiping position to the intermediate position. With this structure, in this embodiment as well as the fifth embodiment, the discharge positions of the waste liquid can be scattered so that the stacking positions of the thickened ink can be scattered.

Figure 20:
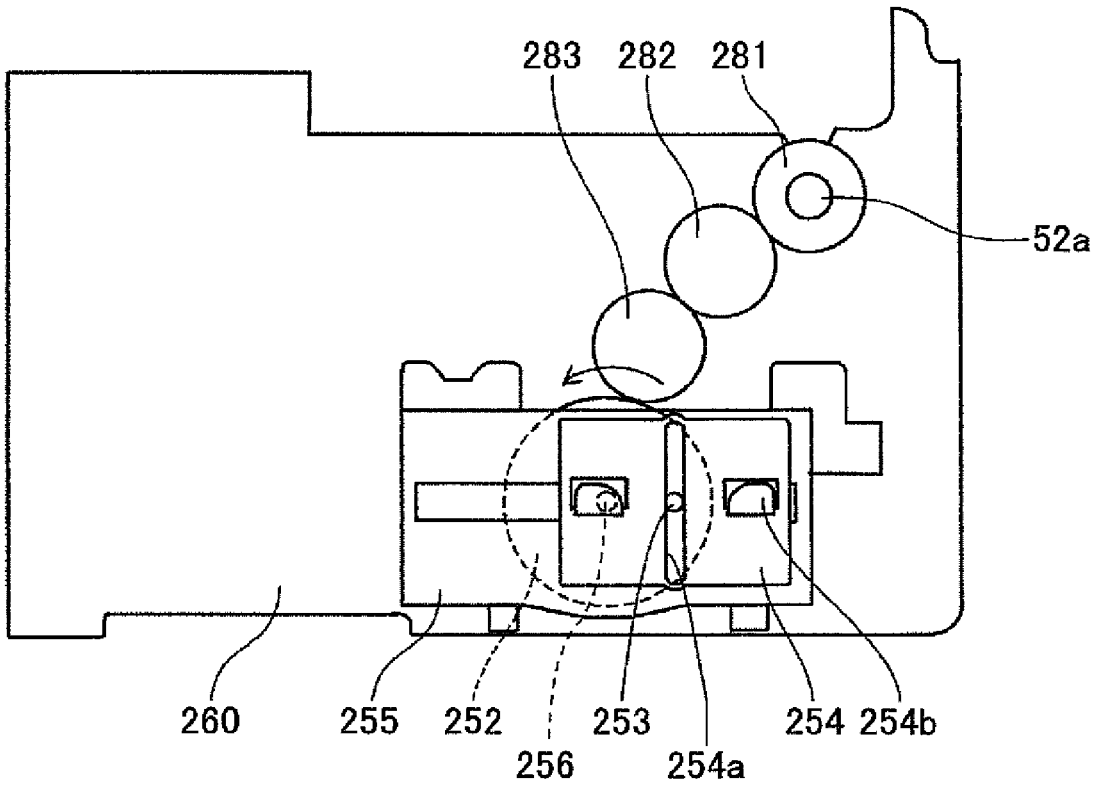
FIG. 20 is a view for explaining a seventh embodiment of the present invention applied to the image forming apparatus.

Next, the maintaining and recovering mechanism including the waste liquid tank applied to an image forming apparatus of a seventh embodiment of the present invention is discussed with reference to FIG. 20. Here, FIG. 20 is a view for explaining the seventh embodiment of the present invention applied to the image forming apparatus.

In this embodiment, an intermediate gear 281 is provided at the shaft 52*a* of the conveyance roller 52 being rotated by a sub-scanning motor (driving source) not shown and configured to move the conveyance belt 51. A driving force is transmitted in order from an intermediate gear 282, via an intermediate gear 283, to the intermediate gear 252 with the cam pin 253 discussed in each of the embodiments.

Accordingly, the first waste liquid tank 100 is moved tied to the conveyance belt 51 which is a conveyance part configured to convey the sheets 42, so that the discharge position of the waste liquid is changed.

By moving the first waste liquid tank 100 tied to the sub-scanning operation (movement of the conveyance part), the first waste liquid tank 100 can be moved independently from the operation of the maintaining and recovering mechanism 81. Therefore, it is possible to freely move the first waste liquid tank 100 even during the maintaining and recovering operation.

The image forming apparatus of the embodiments of the present invention can be applied to a facsimile machine, a copier, and a multi-function machine of a printer, a facsimile, and a copier, etc. Furthermore, the image forming apparatus of the embodiments of the present invention can be used for ejecting a liquid besides the ink, for example, a resist or a liquid including a DNA sample.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. An image forming apparatus, comprising:

a recording head having a nozzle configured to jet a liquid drop of ink;

a cap member configured to be moved between a sealing position where a nozzle surface of the recording head is sealed and an opening position where the nozzle surface is opened;

a waste liquid tank movably provided and configured to receive a waste liquid of the ink, the waste liquid being generated by idle-ejecting the liquid drop not contributing to image forming from the recording head, and the waste liquid tank directly receiving the waste liquid of the ink jetted and dropped from the nozzle of the recording head; and a moving part configured to move the waste liquid tank geared to movement of the cap member, wherein a position of the waste liquid tank in a case of idle-ejection being performed from the recording head last time and another position of the waste liquid tank in a case of idle-ejection being performed from the recording head this time are different, and a moving direction of the cap member is parallel to a jetting direction of the ink from the nozzle, and a moving direction of the waste liquid tank is different from the moving direction of the cap member and the jetting direction of the ink from the nozzle.

2. The image forming apparatus as claimed in claim 1, wherein the waste liquid tank is situated in a first position when the cap member is situated in the sealing position; and the waste liquid tank is situated in a second position different from the first position when the cap member is moved to the sealing position again after the cap member is moved to the opening position.

3. The image forming apparatus as claimed in claim 1, wherein the cap member is configured to be stopped in three or more positions including the sealing position and the opening position.

4. The image forming apparatus as claimed in claim 1, wherein the cap member and the waste liquid tank are separate from each other, and the waste liquid tank receives the waste liquid of the ink jetted from the nozzle and passed through an inlet of the waste liquid tank.

5. The image forming apparatus as claimed in claim 1, wherein the cap member and the waste liquid tank are moved by a same driving source.

6. The image forming apparatus as claimed in claim 1, wherein the waste liquid tank is moved when the cap member is moved from the sealing position to the opening position, before the waste liquid is discharged due to the idle-ejection prior to printing, such that a position in which the waste liquid is discharged relative to the waste liquid tank is changed.

7. The image forming apparatus as claimed in claim 1, further comprising a camshaft configured to move the cap member upward and downward; and an intermediate gear with a cam pin configured to move the waste liquid tank in the moving direction perpendicular to the moving direction of the cap member, wherein a number of rotations of the camshaft differs from a number of rotations of the intermediate gear.

8. The image forming apparatus as claimed in claim 1, wherein the cap member and the waste liquid tank are separate from each other, and the waste liquid of the ink is jetted from the nozzle and dropped into the waste liquid tank.

9. The image forming apparatus as claimed in claim 1, wherein the moving direction of the waste liquid tank is perpendicular to the moving direction of the cap member and the jetting direction of the ink from the nozzle.

* * * * *